US008459447B2

(12) United States Patent
Polloni et al.

(10) Patent No.: US 8,459,447 B2
(45) Date of Patent: Jun. 11, 2013

(54) HINGED-LID PACKAGE

(75) Inventors: Roberto Polloni, Modigliana (IT); Ivanoe Bertuzzi, Casalecchio Di Reno (IT); Marco Ghini, Monte San Pietro (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 13/292,991

(22) Filed: Nov. 9, 2011

(65) Prior Publication Data

US 2012/0118780 A1 May 17, 2012

(30) Foreign Application Priority Data

Nov. 9, 2010 (IT) ..... BO10A0670

(51) Int. Cl.
*B65D 85/10* (2006.01)

(52) U.S. Cl.
USPC ..... 206/86; 206/268; 206/273; 229/160.1; 229/221

(58) Field of Classification Search
USPC ..... 206/236, 242, 265, 268, 271, 273, 206/764, 765; 229/160.1, 207, 210, 211, 229/243, 244, 221
See application file for complete search history.

(56) References Cited

U.S. PATENT DOCUMENTS

| | | | | | |
|---|---|---|---|---|---|
| 3,050,229 | A | * | 8/1962 | Neff | 229/207 |
| 3,069,886 | A | | 12/1962 | Coats | |
| 3,167,238 | A | * | 1/1965 | Smith | 229/207 |
| 3,195,796 | A | * | 7/1965 | Buttery | 229/207 |
| 4,621,649 | A | | 11/1986 | Osterrath | |
| 4,687,104 | A | * | 8/1987 | Ielmini | 229/207 |
| 4,746,019 | A | * | 5/1988 | Prater | 229/207 |
| 4,813,594 | A | * | 3/1989 | Brown et al. | 229/103 |
| 4,836,438 | A | * | 6/1989 | Rigby | 229/207 |
| 4,886,170 | A | * | 12/1989 | Willey et al. | 229/207 |
| 5,078,273 | A | * | 1/1992 | Kuchenbecker | 229/207 |
| 5,226,532 | A | * | 7/1993 | Davidson et al. | 229/244 |
| 5,411,205 | A | * | 5/1995 | Pfieffer | 229/244 |
| 5,908,734 | A | | 6/1999 | Okui et al. | |
| 7,121,403 | B2 | * | 10/2006 | Bohdan et al. | 206/273 |

FOREIGN PATENT DOCUMENTS

| | | | |
|---|---|---|---|
| DE | 3530808 | A1 | 3/1987 |
| DE | 10 2004 013741 | A1 | 10/2005 |
| EP | 0 899 201 | A1 | 3/1999 |
| EP | 1 792 832 | A1 | 6/2007 |
| FR | 1 568 665 | A | 5/1969 |
| WO | WO-98/15461 | A1 | 4/1998 |

OTHER PUBLICATIONS

Italian Search Report in Italian Application No. IT B020100670, dated Jul. 1, 2011.

* cited by examiner

*Primary Examiner* — Luan K Bui
(74) *Attorney, Agent, or Firm* — Marshall, Gerstein & Borun LLP

(57) ABSTRACT

A package having a parallelepiped-shaped container, which is cup-shaped and has a bottom wall, an open top end opposite the bottom wall, a front wall and a rear wall opposite and parallel to each other, and two parallel lateral walls interposed between the front wall and the rear wall; and a lid, which rotates between a closed position and an open position respectively closing and opening the open top end of the container, and has a top wall hinged to the rear wall of the container, and a front wall which, in the closed position, is superimposed on the front wall of the container.

16 Claims, 28 Drawing Sheets

HINGED-LID PACKAGE

CROSS-REFERENCE TO RELATED APPLICATIONS

This application claims the benefit of Italian Patent Application No. BO2010A 000670, filed Nov. 9, 2010.

TECHNICAL FIELD

The present invention relates to a hinged-lid package.

In the following description, reference is made, for the sake of simplicity and purely by way of a non-limiting example, to a hinged-lid packet of cigarettes, preferably containing a lighter and a group of cigarettes.

BACKGROUND ART

Various types of rigid packets of cigarettes containing a rigid object, normally a lighter, have been proposed, as described, for example, in Patents DE102004013741A1, U.S. Pat. No. 5,908,734A1, U.S. Pat. No. 4,621,649A1, DE3530808A1, U.S. Pat. No. 3,069,886A1 and U.S. Pat. No. 5,908,734.

Known rigid packets of cigarettes containing a lighter, however, are extremely complicated to produce on a standard packing machine, and so either require a specially designed, much more expensive machine (normally with a low output rate), or fail to adequately protect the lighter.

Patent Application EP1792832A1 describes a hinged-lid package formed by folding one blank and comprising:

a parallelepiped-shaped, cup-shaped container comprising a bottom wall; an open top end opposite the bottom wall; a front wall and an opposite, parallel rear wall; and two parallel lateral walls interposed between the front and rear walls;

a lid, which rotates between a closed position and an open position closing and opening the top end of the container respectively, and which comprises a top wall hinged to the rear wall of the container; and a front wall which, in the closed position, is superimposed on the front wall of the container; and a border, which is parallel to the bottom wall, surrounds the open top end on all four sides, thus reducing the size of the open top end, and on which the top wall of the lid rests in the closed position.

DESCRIPTION OF THE INVENTION

It is an object of the present invention to provide a hinged-lid package that is cheap and easy to produce.

According to the present invention, there is provided a hinged-lid package, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
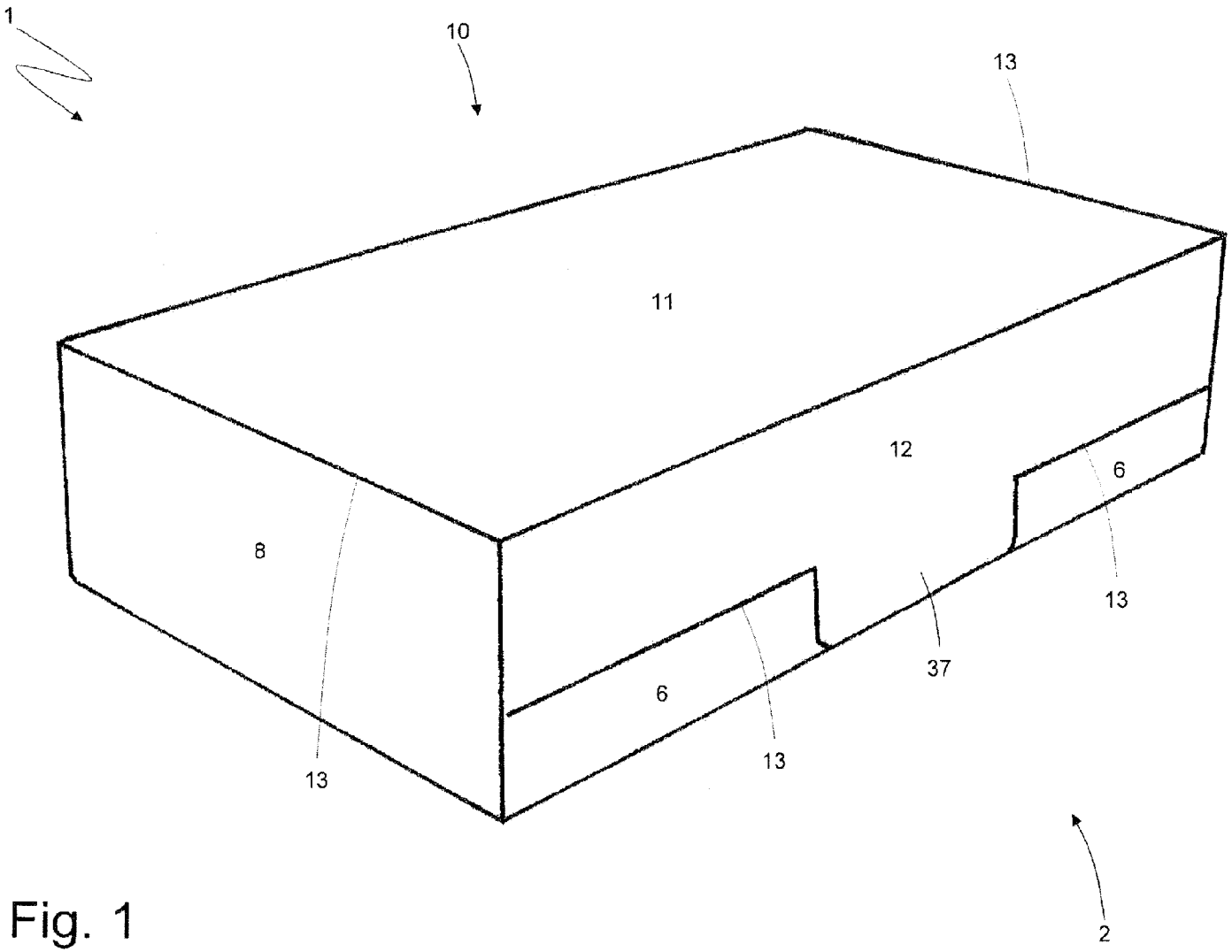
FIG. 1 shows a front view in perspective of a hinged-lid packet of cigarettes in accordance with the present invention in a closed configuration.
Figure 2:
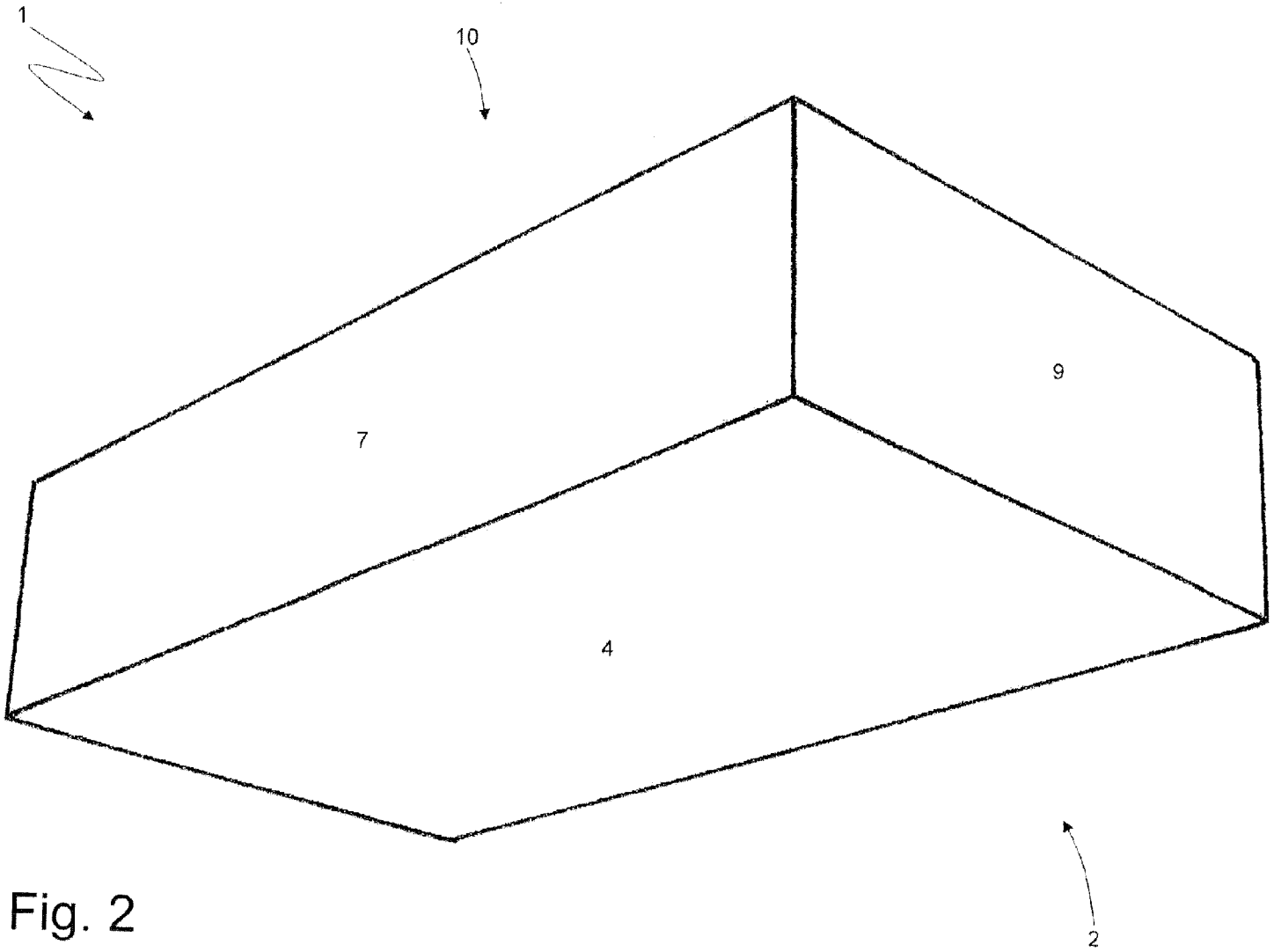
FIG. 2 shows a rear view in perspective of the FIG. 1 packet of cigarettes in the closed configuration.
Figure 3:
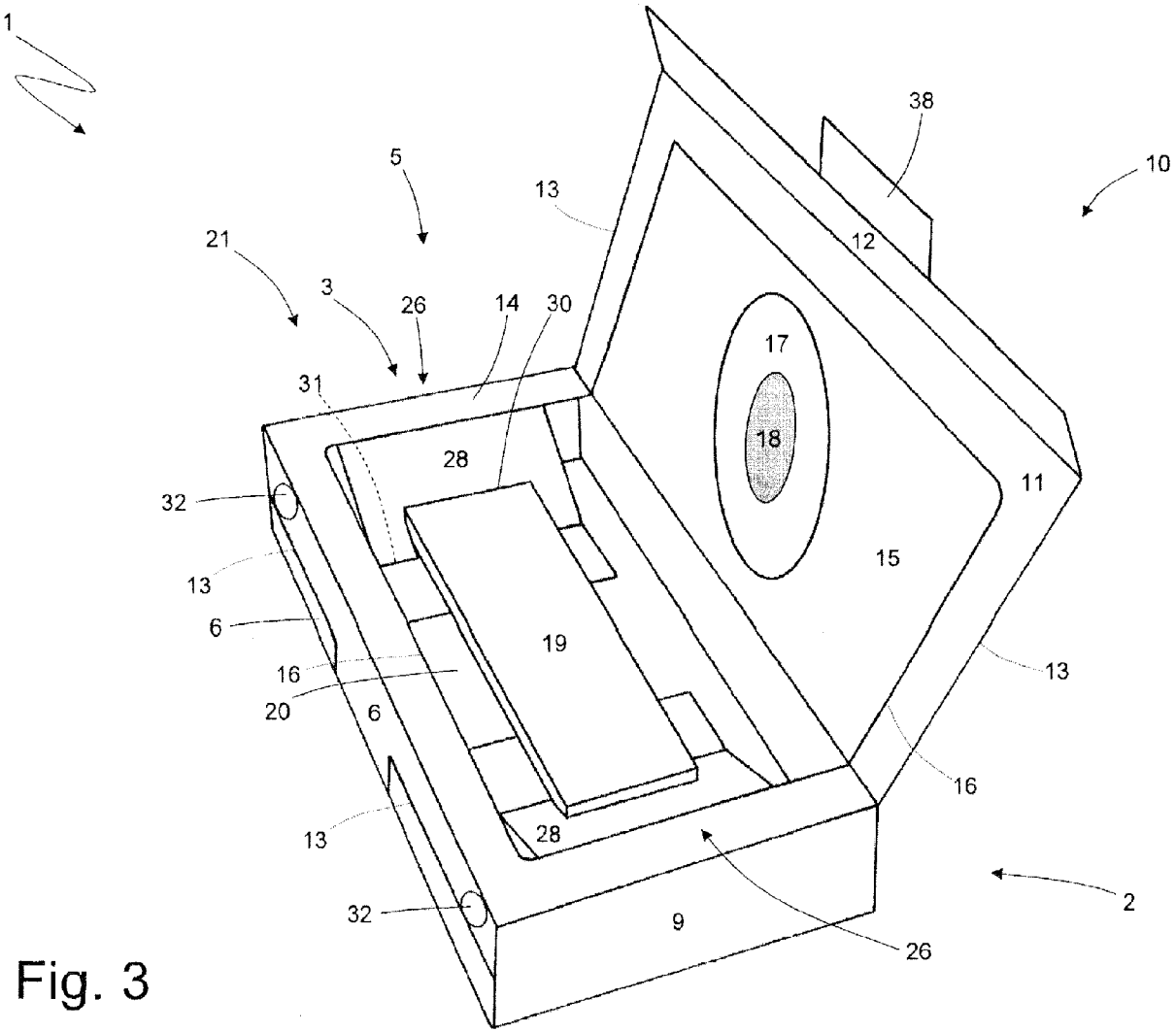
FIG. 3 shows a front view in perspective of the FIG. 1 packet of cigarettes in an open configuration.
Figure 4:
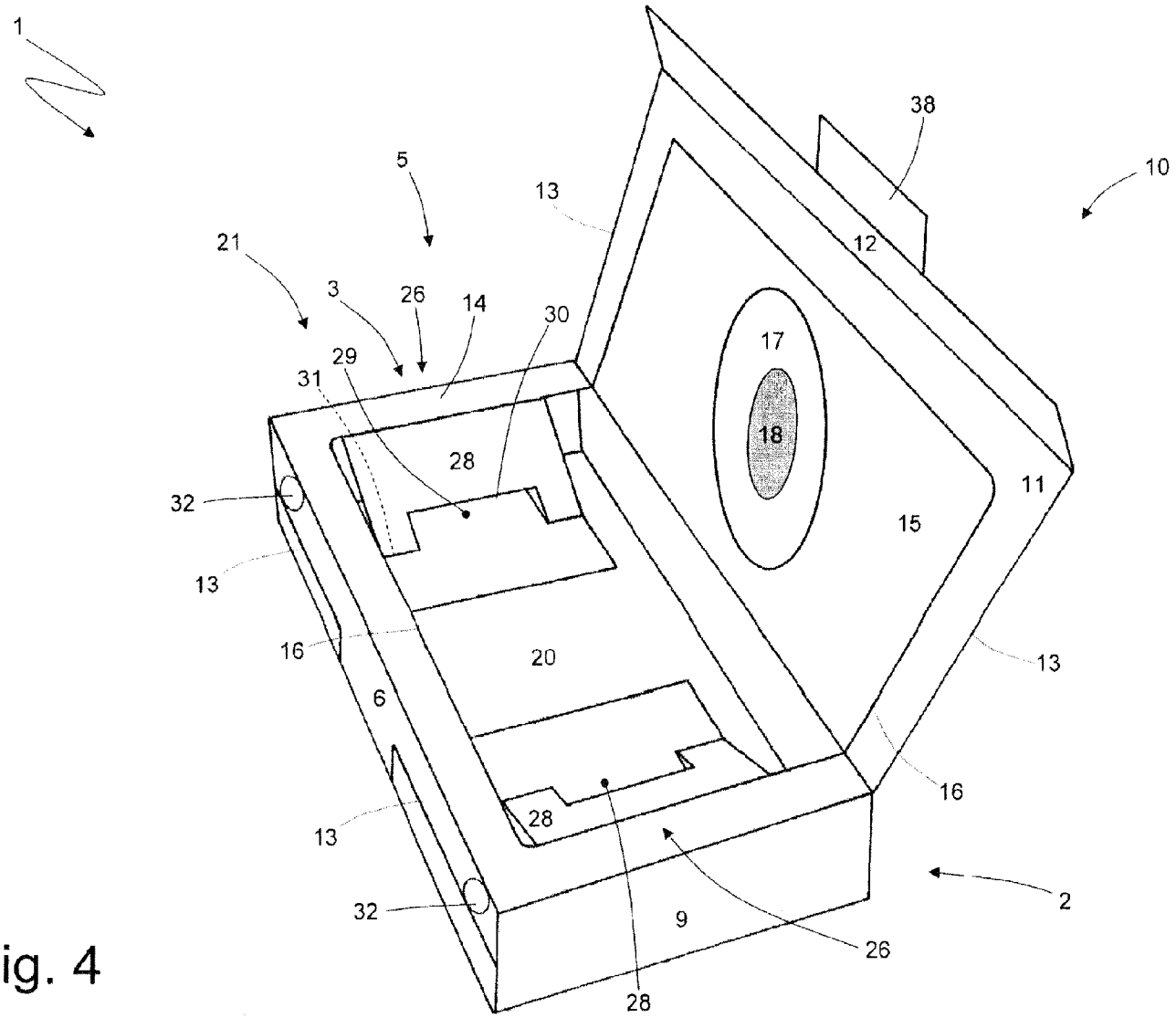
FIG. 4 shows a front view in perspective of the FIG. 1 packet of cigarettes in the open configuration, and with an object, contained inside the packet, removed.

Number 1 in FIGS. 1, 2 and 3 indicates as a whole a rigid, hinged-lid packet of cigarettes.

The FIG. 1 packet 1 of cigarettes comprises a rigid container 2 made of cardboard or similar and housing a content 3 (shown as a whole in FIG. 3). Container 2 is in the form of a cup-shaped parallelepiped, and comprises a bottom wall 4; an open top end 5 opposite bottom wall 4; a front wall 6 and an opposite, parallel rear wall 7; and two parallel lateral walls 8, 9 interposed between walls 6 and 7. Container 2 has an integral lid 10, which rotates between a closed position (FIGS. 1 and 2) and an open position (FIG. 3) to close and open top end 5 of container 2 respectively, and which comprises a top wall 11 hinged to rear wall 7 of container 2 by a hinge defined between an edge of rear wall 7 of container 2 and an edge of top wall 11. In the closed position, the top wall 11 of lid 10 is opposite and parallel to bottom wall 4 of container 2. Lid 10 also comprises a front wall 12, which is normally perpendicular to top wall 11 of lid 10, and, in the closed position, is superimposed on front wall 6 of container 2.

In the embodiment shown, the longitudinal and transverse edges defined between walls 4, 6-9, 11 and 12 of container 2 and lid 10 are square, but, in an alternative embodiment not shown, at least some longitudinal and/or transverse edges are rounded or bevelled.

In a preferred embodiment, lid 10 is initially connected to container 2 along a tear line 13, which is torn, when unsealing lid 10, to separate lid 10 permanently from container 2. Tear line 13 serves to hold lid 10 firmly in the closed position until it is unsealed, and also acts as a 'guarantee seal' ensuring packet 1 of cigarettes has not been tampered with. In the FIG. 1-13 embodiment, tear line 13 extends along the bottom edge of front wall 12 of lid 10 to connect front wall 12 of lid 10 to the underlying front wall 6 of container 2, and also extends along the lateral edges of top wall 11 of lid 10 to connect top wall 11 of lid 10 to lateral walls 8 and 9 of container 2. In the FIG. 14-22 embodiments, tear line 13 only extends along the bottom edge of front wall 12 of lid 10 to connect front wall 12 of lid 10 to the underlying front wall 6 of container 2.

In a preferred embodiment, a border 14, parallel to bottom wall 4, surrounds open top end 5 on at least three sides, reduces the size of open top end 5, and supports top wall 11 of lid 10 in the closed position. In the FIG. 1-11 embodiment, border 14 extends along the edge of front wall 6 and the edges of lateral walls 8 and 9 of container 2, but not along the edge of rear wall 7 of container 2; whereas, in the FIGS. 12 and 13 embodiments, border 14 also extends along part of rear wall 7 of container 2.

Border 14 preferably (though not necessarily) comprises a cover 15, which initially closes the whole of open top end 5 within border 14, is initially connected to the edges of border 14 along a tear line 16, and is glued to the inner surface of top wall 11 of lid 10 so as to be torn off border 14 along tear line 16 when lid 10 is unsealed. In other words, when packet 1 of cigarettes is sealed, cover 15 is connected on all four sides to border 14, and, when lid 10 is unsealed, is torn off border 14 on all four sides along tear line 16. Tear line 16 preferably extends seamlessly about all four sides of cover 15, but may alternatively be U-shaped, i.e. interrupted at rear wall 7 of container 2 (in which case, cover 15 is separated completely from border 14 at rear wall 7 of container 2 from the outset).

In a preferred embodiment, cover 15 has a central through hole 17, which plays an important part in the manufacture of packet 1 of cigarettes, as explained below. In one embodiment, the inner surface of top wall 11 of lid 10 has printing 18 located at and visible through hole 17 in cover 15.

The content 3 of packet 1 of cigarettes comprises a rigid, parallelepiped-shaped object 19 (normally, though not necessarily, a lighter); and a parallelepiped-shaped article 20 defined by a wrapped group of cigarettes, i.e. wrapped in a sheet of foil wrap. In FIG. 3, object 19 is clearly visible in the forefront, whereas article 20 underneath object 19 is only partly visible.

Figure 5:
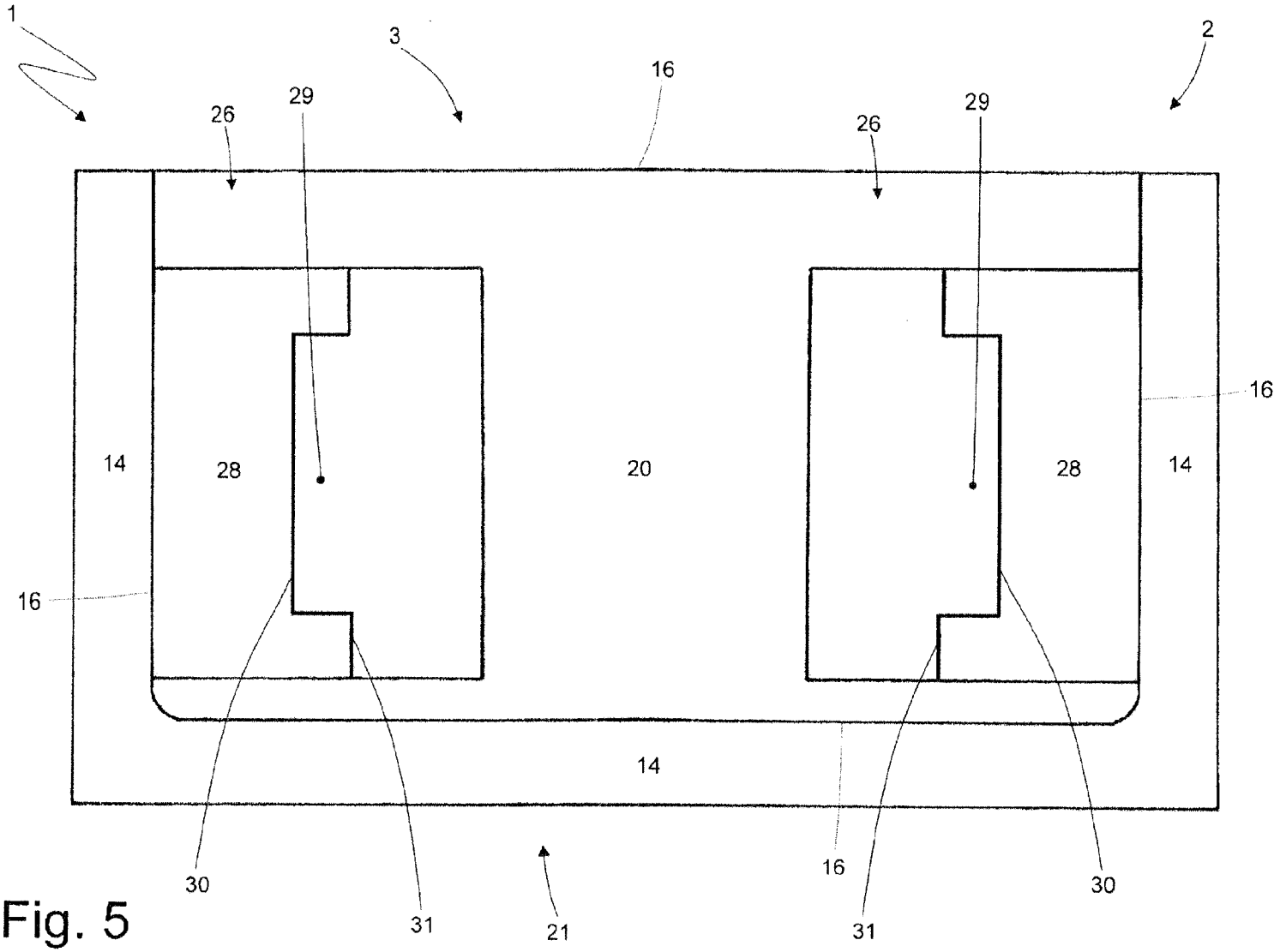
FIG. 5 shows a plan view of the FIG. 1 packet of cigarettes in the open configuration, and with an object, contained inside the packet, removed.
Figure 6:
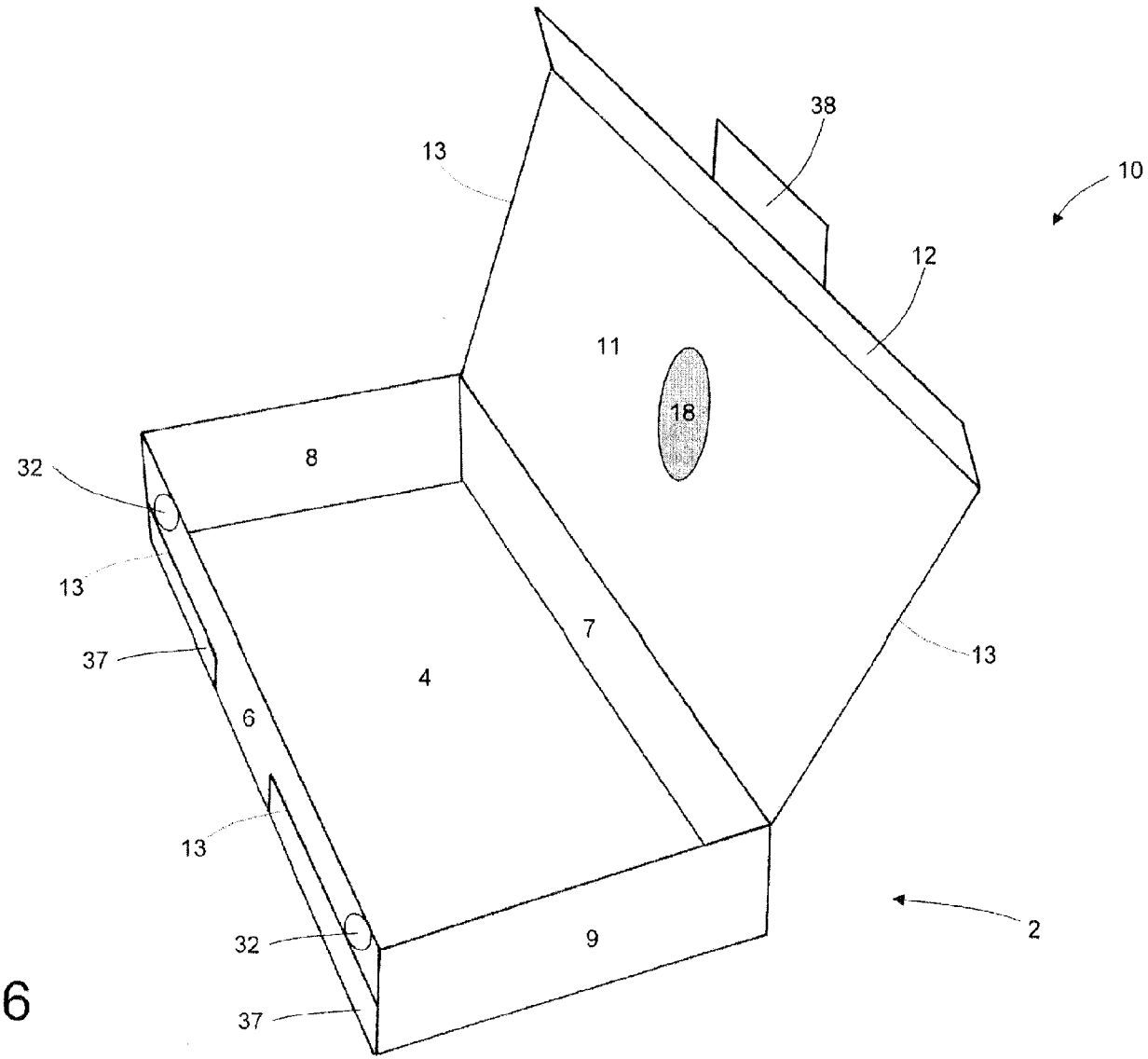
FIG. 6 shows a front view in perspective of the FIG. 1 packet of cigarettes in the open configuration, and with the content and an insert supporting the content removed.
Figure 7:
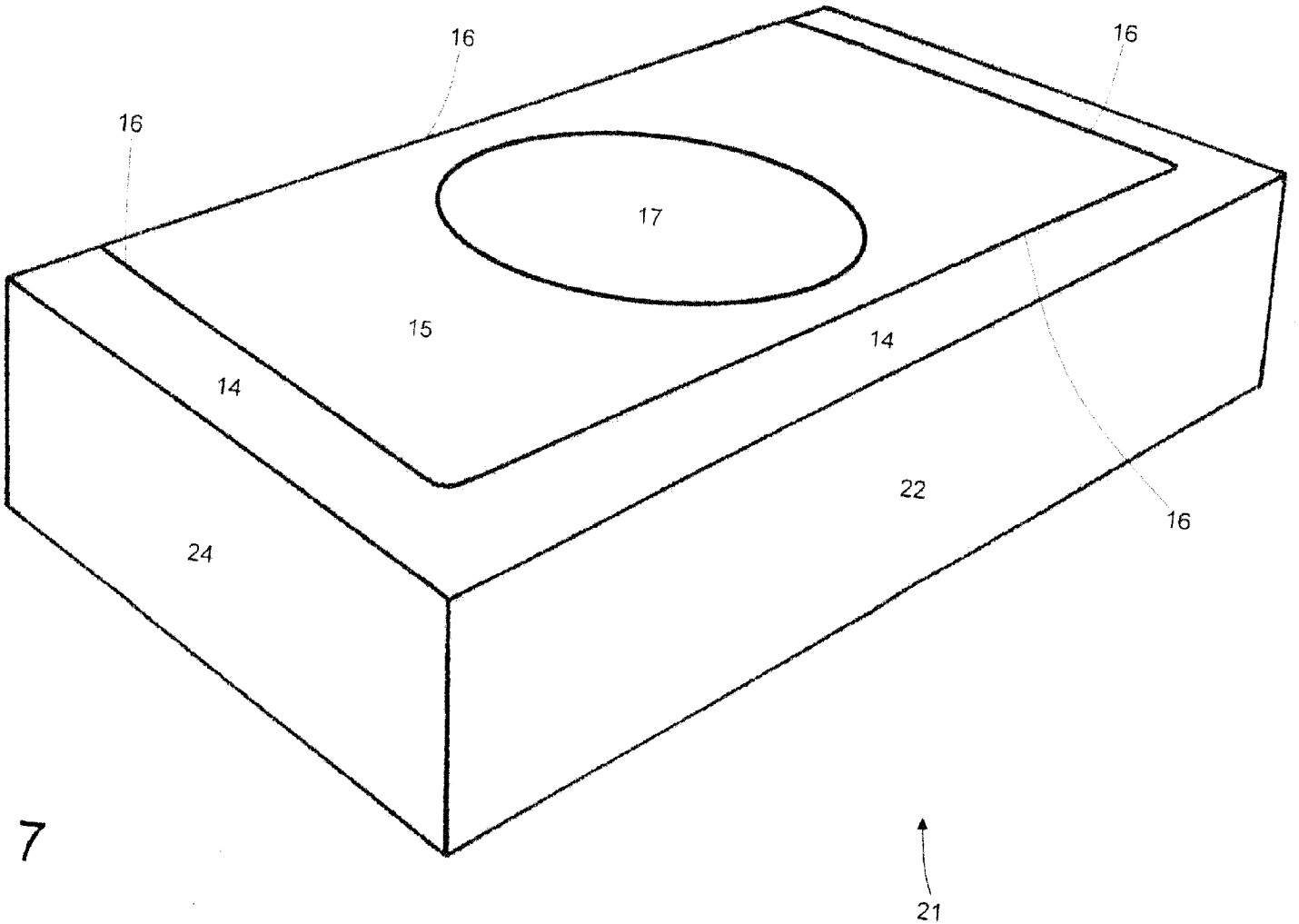
FIG. 7 shows a topside view in perspective of an insert of the FIG. 1 packet of cigarettes.
Figure 8:
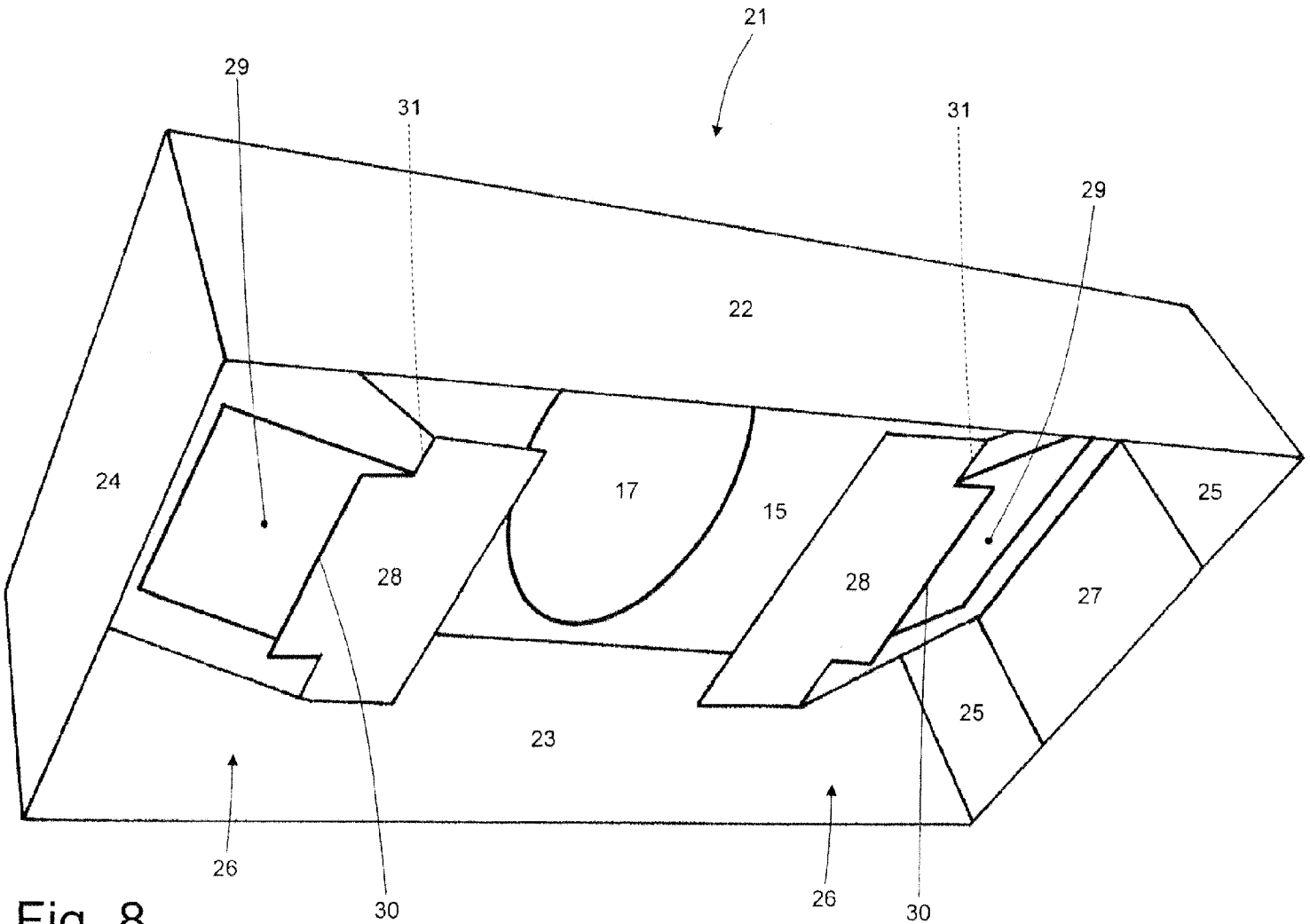
FIG. 8 shows a plan view of the FIG. 6 insert.

In a preferred embodiment, packet 1 of cigarettes comprises an insert 21, which comprises border 14, is initially separate from container 2, and is glued to the inside of container 2. As shown in FIGS. 5, 7 and 8, insert 21 comprises a front wall 22, which is glued to the inner surface of front wall 6 of container 2; a rear wall 23, which is glued to the inner surface of rear wall 7 of container 2; and two lateral walls 24, 25, which are glued to the inner surfaces of lateral walls 8, 9 of container 2.

Insert 21 comprises two supports 26 connected to lateral walls 24, 25, and projecting inwards of container 2 to support object 19. Each support 26 comprises a tab 27 connected to the bottom edge of lateral wall 24, 25 of insert 21, and which is folded onto and glued to lateral wall 24, 25 of insert 21; and a tab 28 connected to tab 27 and projecting inwards of container 2 to support object 19 (i.e. part of content 3 of container 2). Each tab 28 comprises a central through recess 29 engaged by rigid object 19 and defined by a U-shaped through cut 30; and a fold line 31, which forms an intermediate fold in tab 28, and is located at the tips of U-shaped through cut 30.

In a preferred embodiment, packet 1 of cigarettes comprises a retaining system for holding lid 10 in the closed position after it is unsealed (before it is unsealed, lid 10 is held firmly in the closed position by tear line 13, which is torn to unseal lid 10). In the embodiment shown, the lid retaining system comprises (by way of example) two spots 32 of glue applied to front wall 6 of container 2, and to which the inner surface of front wall 12 of lid 10 adheres when lid 10 is in the closed position. Spots 32 are made of non-dry, weak-stick glue, which remains adhesive even after frequent use, thus enabling lid 10 to be opened and closed repeatedly.

Figure 9:
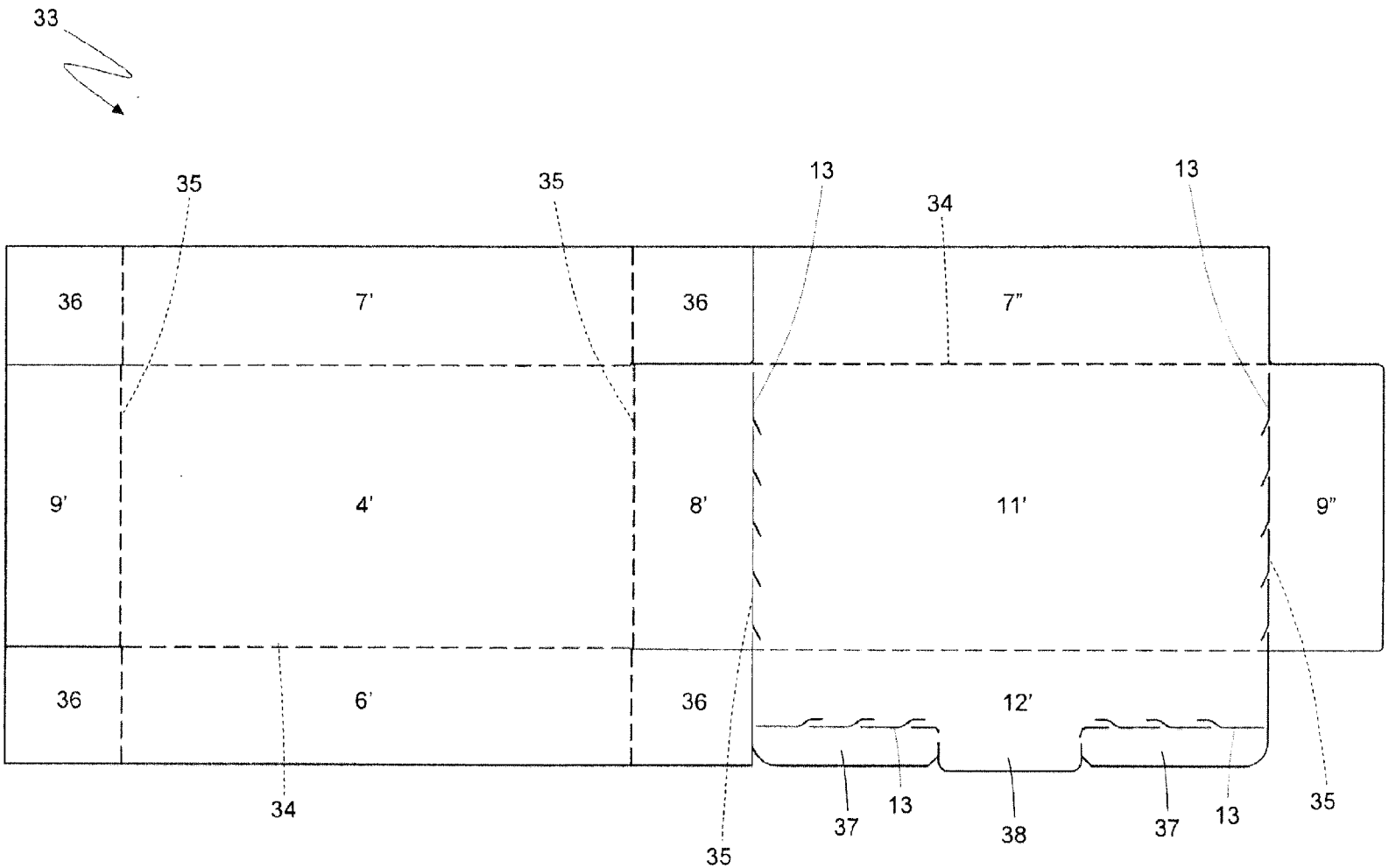
FIG. 9 shows a spread-out plan view of a blank by which to form the FIG. 1 packet of cigarettes.

Container 2 and lid 10 are formed by folding a single blank 33 as shown in FIG. 9. Among other things, blank 33 comprises a number of panels, which are indicated, where possible, using the same reference numbers, with superscripts, as for the corresponding walls of container 2 and lid 10.

As shown in FIG. 9, blank 33 has two longitudinal fold lines 34, and a number of transverse fold lines 35 defining, between longitudinal fold lines 34, a panel 9' forming an inner portion of lateral wall 9 of container 2; a panel 4' forming bottom wall 4 of container 2; a panel 8' forming lateral wall 8 of container 2; a panel 11' forming top wall 11 of lid 10; and a panel 9" forming an outer portion of lateral wall 9 of container 2. Panels 9' and 9" are superimposed and glued to form lateral wall 9 of container 2.

Blank 33 comprises a panel 7' connected to panel 4' along one longitudinal fold line 34, and which forms an inner portion of rear wall 7 of container 2; and a panel 6' connected to panel 4' along the other longitudinal fold line 34, and which forms front wall 6 of container 2. Panel 6' and panel 7' each have two tabs 36, which are connected to panel 6', 7' along transverse fold lines 35, are folded 90° with respect to panel 6', 7', and are glued to the inner surfaces of panel 9' and panel 8' respectively.

Blank 33 comprises a panel 7" connected to panel 11' along one longitudinal fold line 34, and which forms an outer portion of rear wall 7 of container 2; and a panel 12' connected to panel 11' along the other longitudinal fold line 34, and which forms front wall 12 of lid 10. Panel 12' comprises two detachable portions 37, which are glued to panel 6' forming front wall 6 of container 2 (and so form an integral part of front wall 6 of container 2), and are connected along tear line 13 to the rest of panel 12' forming front wall 12 of lid 10. The two detachable portions 37 are separated completely by a user grip tab 38, by which to pull up lid 10 to open packet 1 of cigarettes.

On either side of panel 11', tear line 13 coincides with corresponding transverse fold lines 35.

Figure 10:
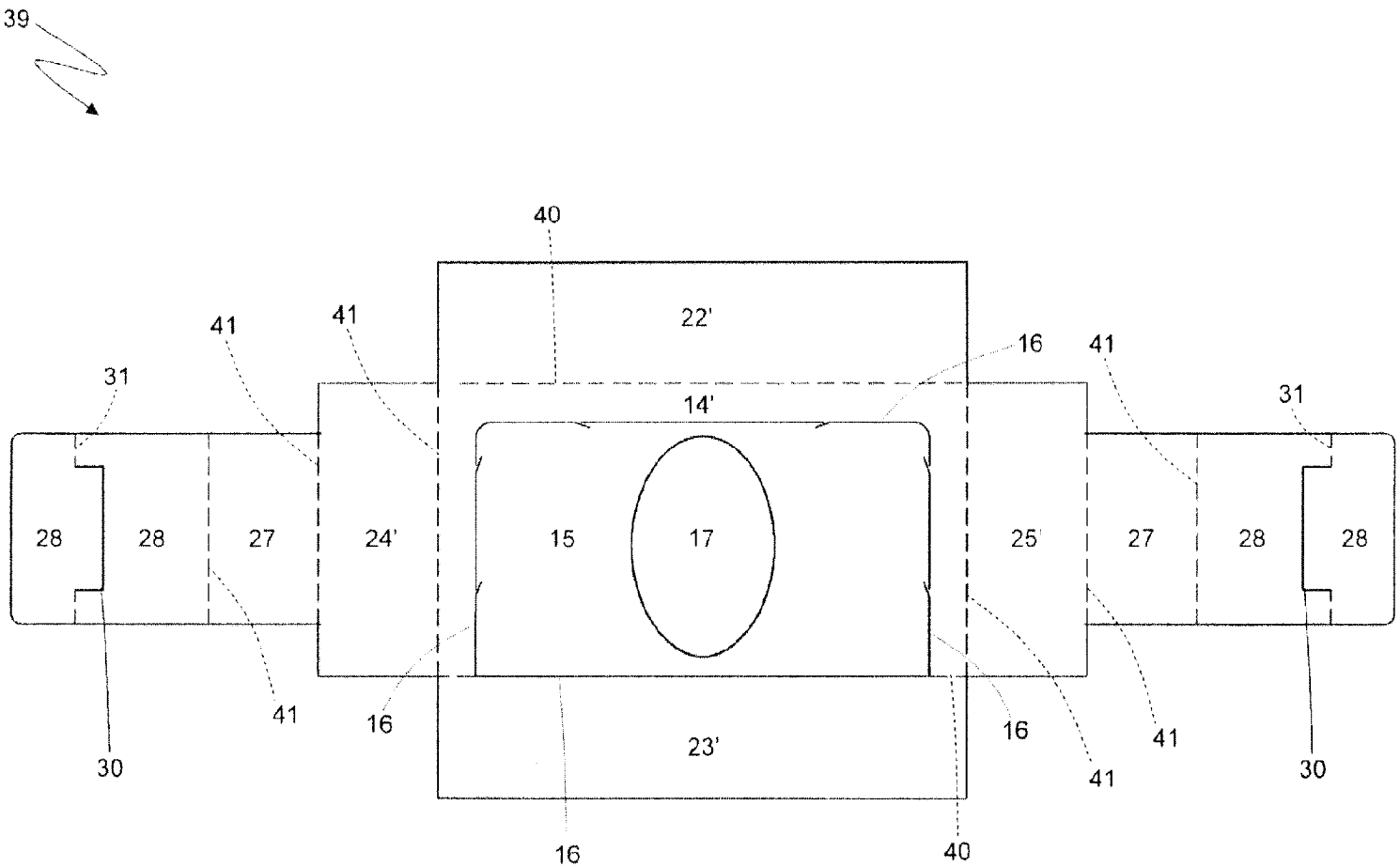
FIG. 10 shows a spread-out plan view of a blank by which to form an insert of the FIG. 1 packet of cigarettes.

Insert 21 is formed by folding a blank 39, as shown in FIG. 10. Among other things, blank 39 comprises a number of panels, which are indicated, where possible, using the same reference numbers, with superscripts, as for the corresponding walls of insert 21.

As shown in FIG. 10, blank 39 has two longitudinal fold lines 40, and a number of transverse fold lines 41 defining, between longitudinal fold lines 40, a panel 24' forming lateral wall 24; a panel 14' forming border 14; and a panel 25' forming lateral wall 25. Panels 24', 25' are each connected along a transverse fold line 41 to a tab 27, in turn connected along another transverse fold line 41 to a tab 28.

Figure 11:
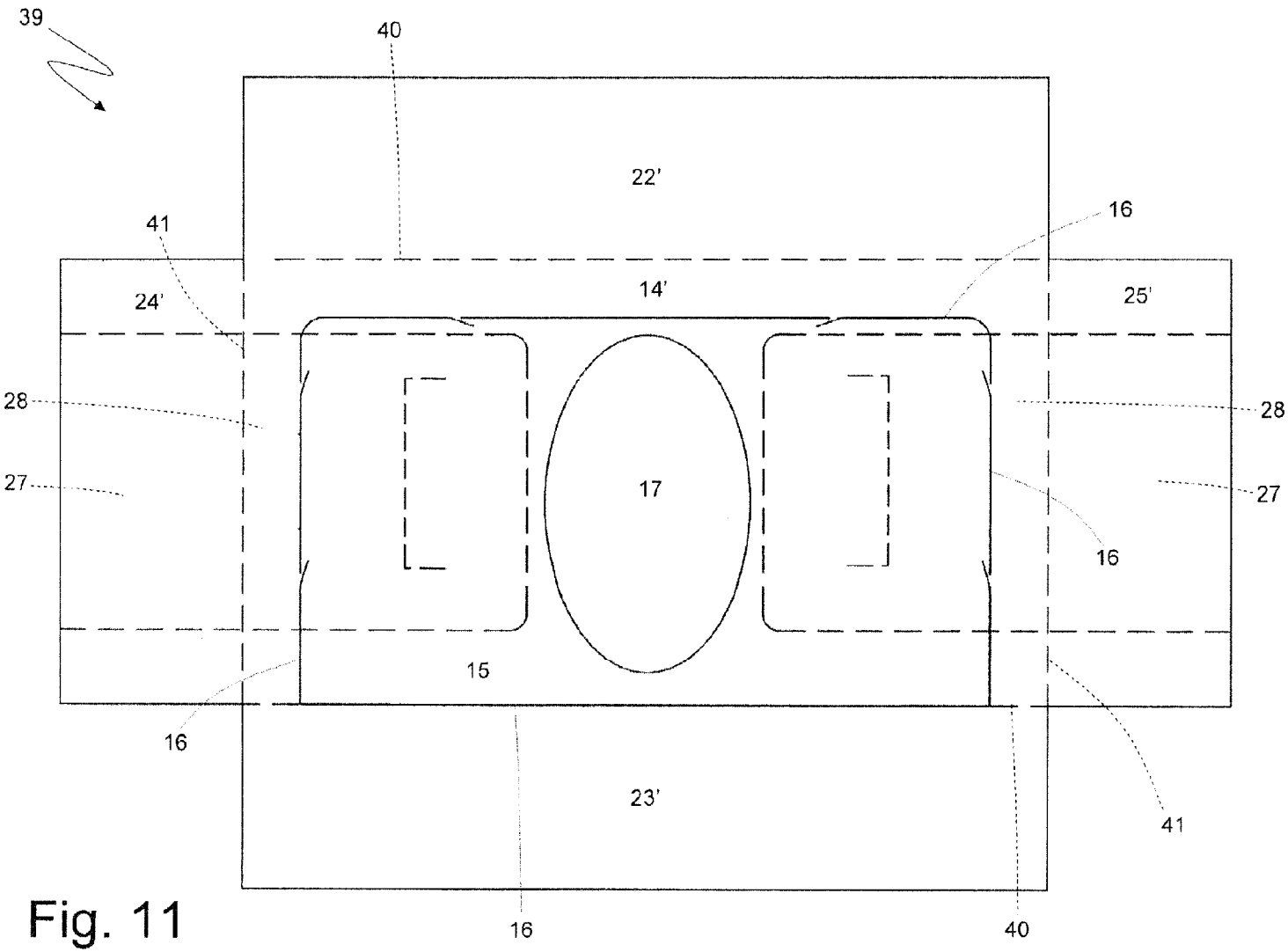
FIG. 11 shows a partly folded plan view of the FIG. 10 blank.

FIG. 11 shows the FIG. 10 blank 39 following an initial folding operation, which may be performed either on, or before feeding blank 39 to, the packing machine producing packet 1 of cigarettes (e.g. by the manufacturer of blank 39). The initial folding operation comprises folding tabs 27 (together with tabs 28) 180° onto corresponding panels 24', 25', after first applying permanent glue between tabs 27 and panels 24', 25', so that, when the initial folding operation is completed, tabs 27 are superimposed on and glued to corresponding panels 24', 25'.

Figure 12:
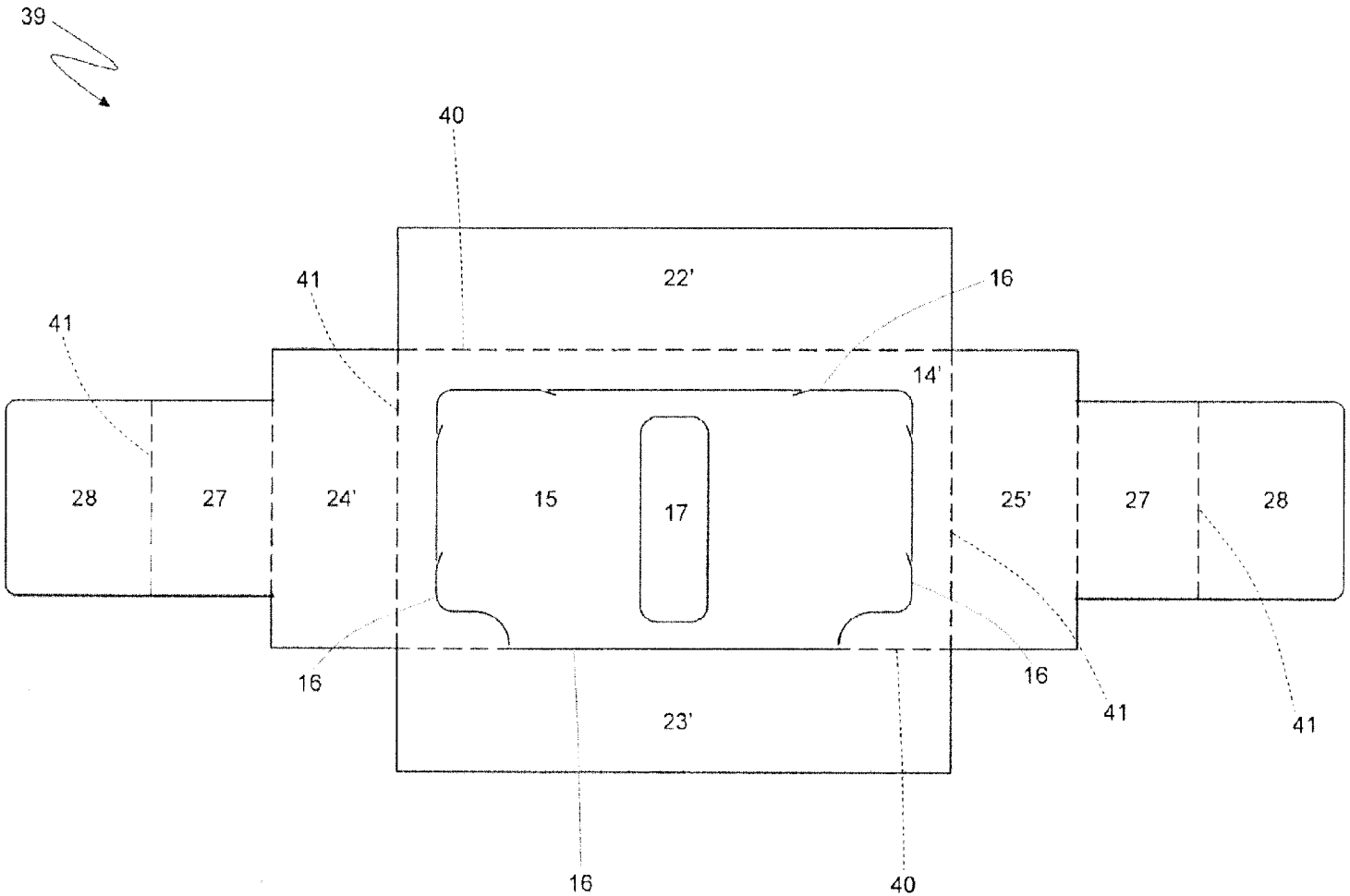
FIG. 12 shows a spread-out plan view of an alternative embodiment of the FIG. 10 blank.

FIG. 12 shows a variation of the FIG. 10 blank 39, designed for a content 3 with no object 19 (i.e. only comprising one or more articles 20, i.e. one or more wrapped groups of cigarettes). In the FIG. 12 embodiment, blank 39 (and therefore insert 21) has no cuts 30 in tabs 28; and tabs 28 of insert 21 act as 'elastic members', which push content 3 towards open top end 5 of container 2 to steady content 3 inside container 2 when lid 10 is in the closed position, and to make content 3 easier to withdraw when lid 10 is in the open position.

Figure 13:
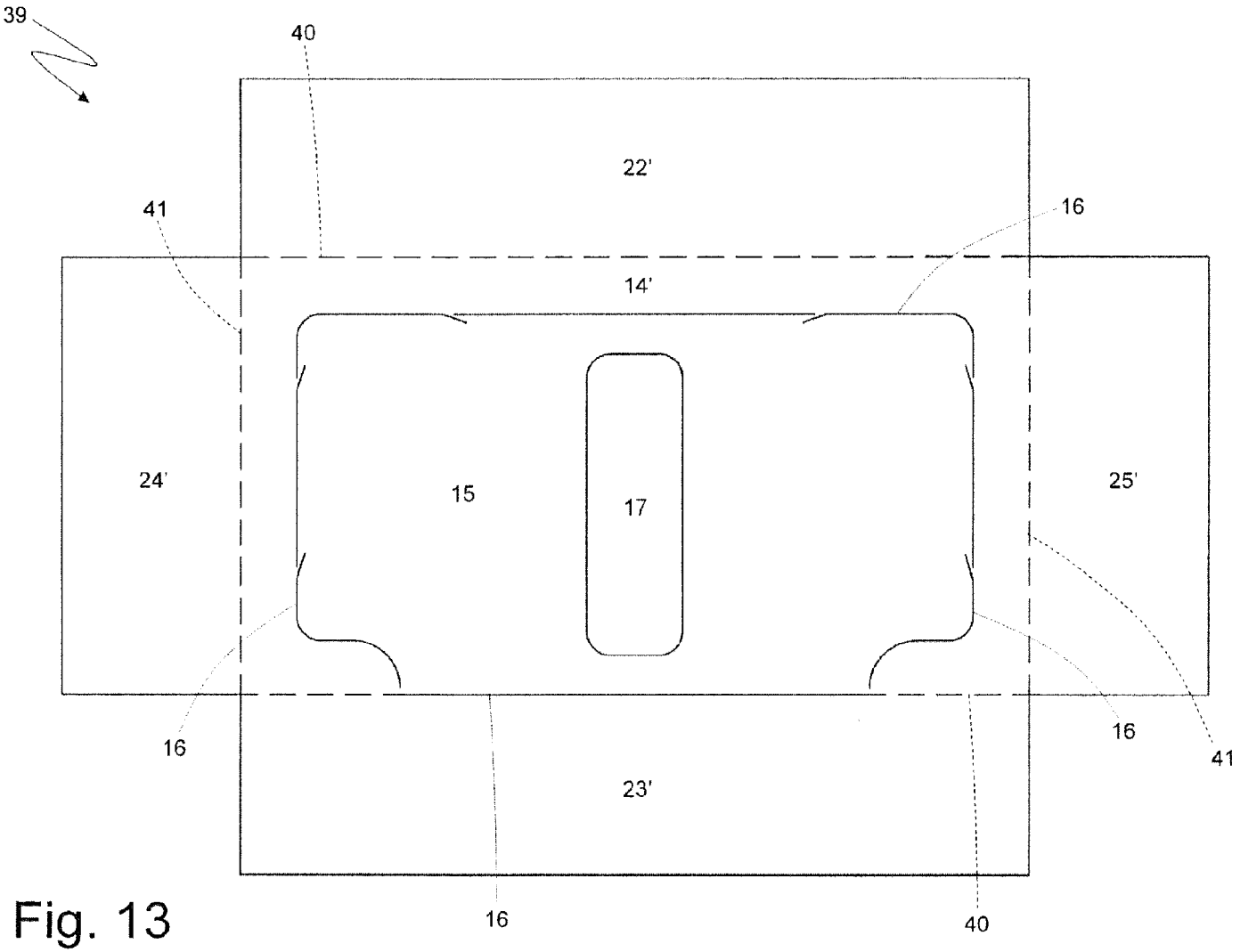
FIG. 13 shows a spread-out plan view of a further embodiment of the FIG. 10 blank.

FIG. 13 shows another variation of the FIG. 10 blank 39, designed for a content 3 with no object 19 (i.e. only comprising one or more articles 20, i.e. one or more wrapped groups of cigarettes). In the FIG. 13 embodiment, blank 39 (and therefore insert 21) has no tabs 27 or 28, and so provides no support for content 3.

Figure 14:
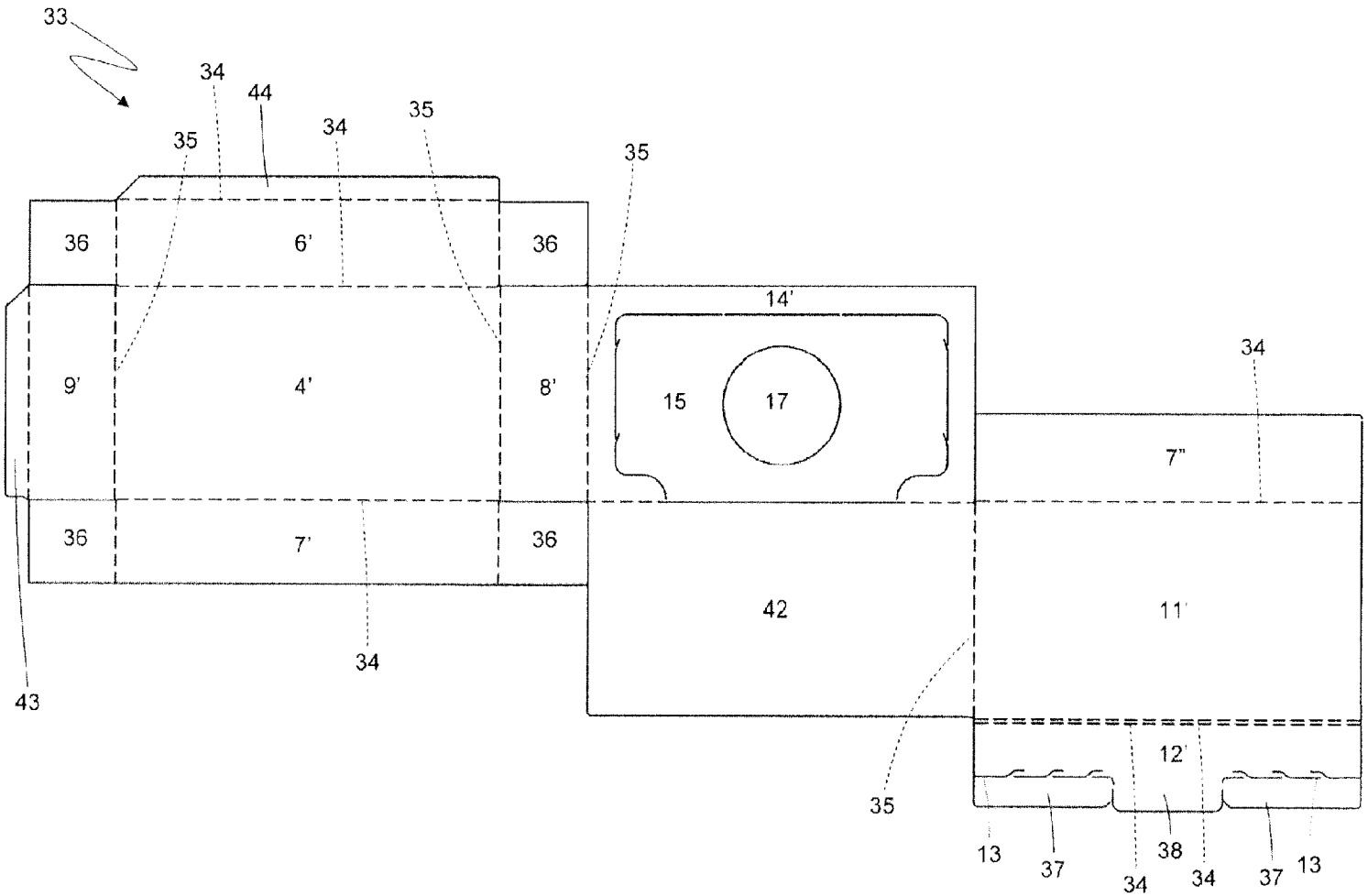
FIG. 14 shows a spread-out plan view of a blank by which to form the FIG. 1 packet of cigarettes, and also incorporating an insert.

FIG. 14 shows a different embodiment of blank 33, which also incorporates blank 39, i.e. blank 33 for forming container 2 and lid 10 also forms insert 21.

Blank 33 in FIG. 14 comprises a panel 14', which forms border 14, is connected to panel 8' along a transverse fold line 35, and is superimposed on panel 11; and a panel 42, which is connected to panel 14' along a longitudinal fold line 34, is connected to panel 11' along a transverse fold line 35, and is interposed between panels 14' and 11'.

Figure 15:
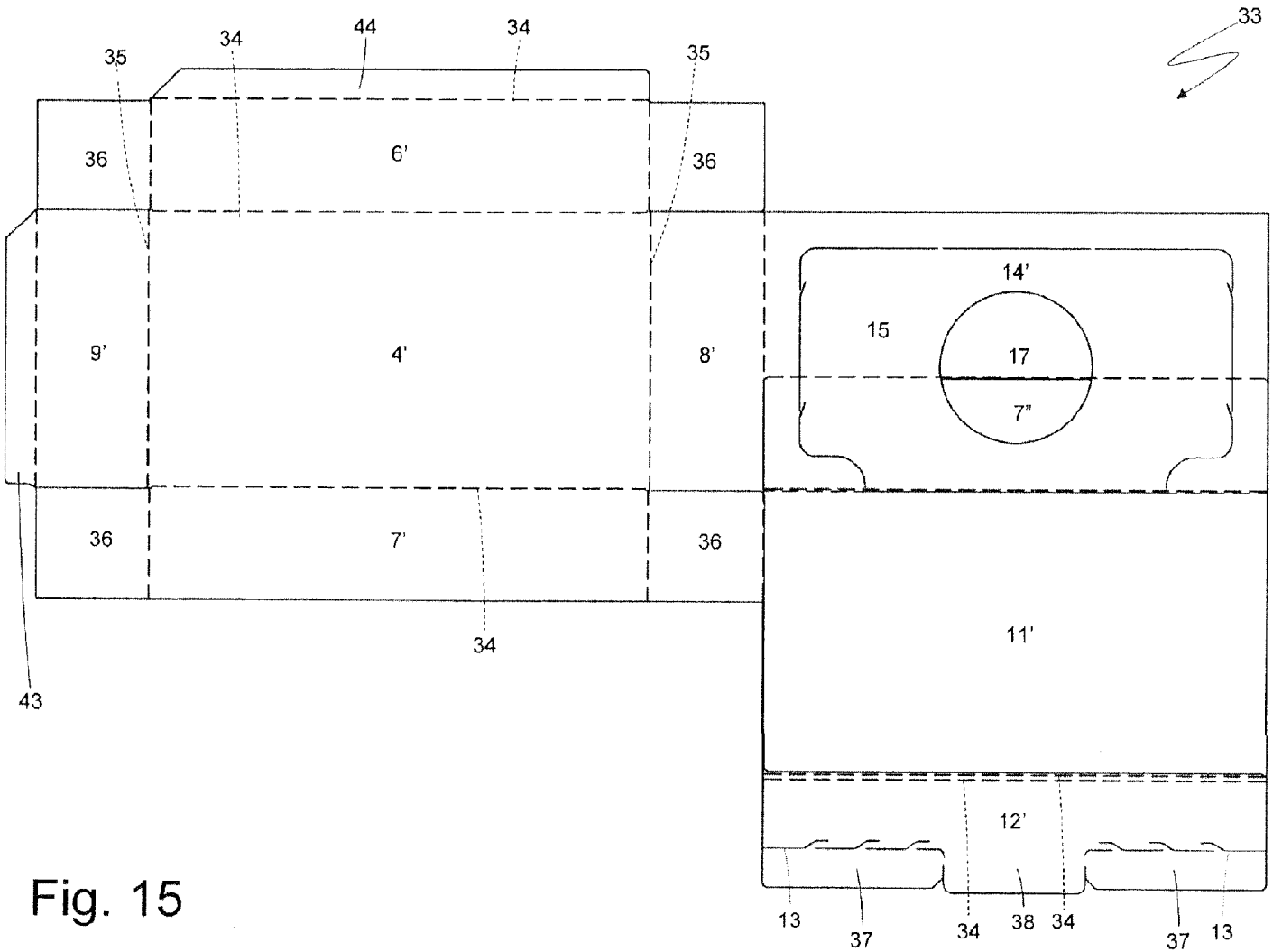
FIGS. 15 and 16 show plan views of the FIG. 14 blank partly folded.
Figure 16:
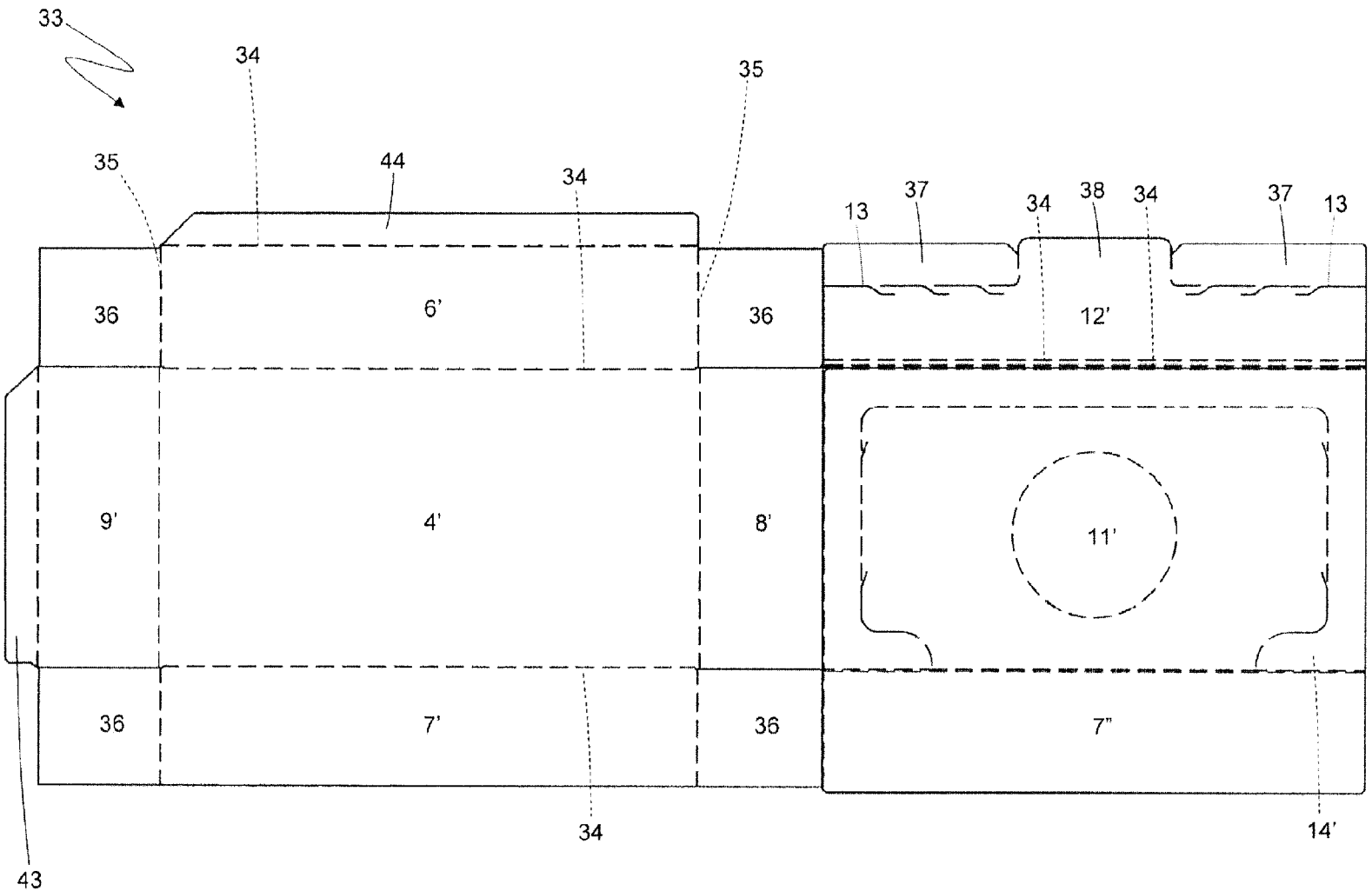
Figure 17:
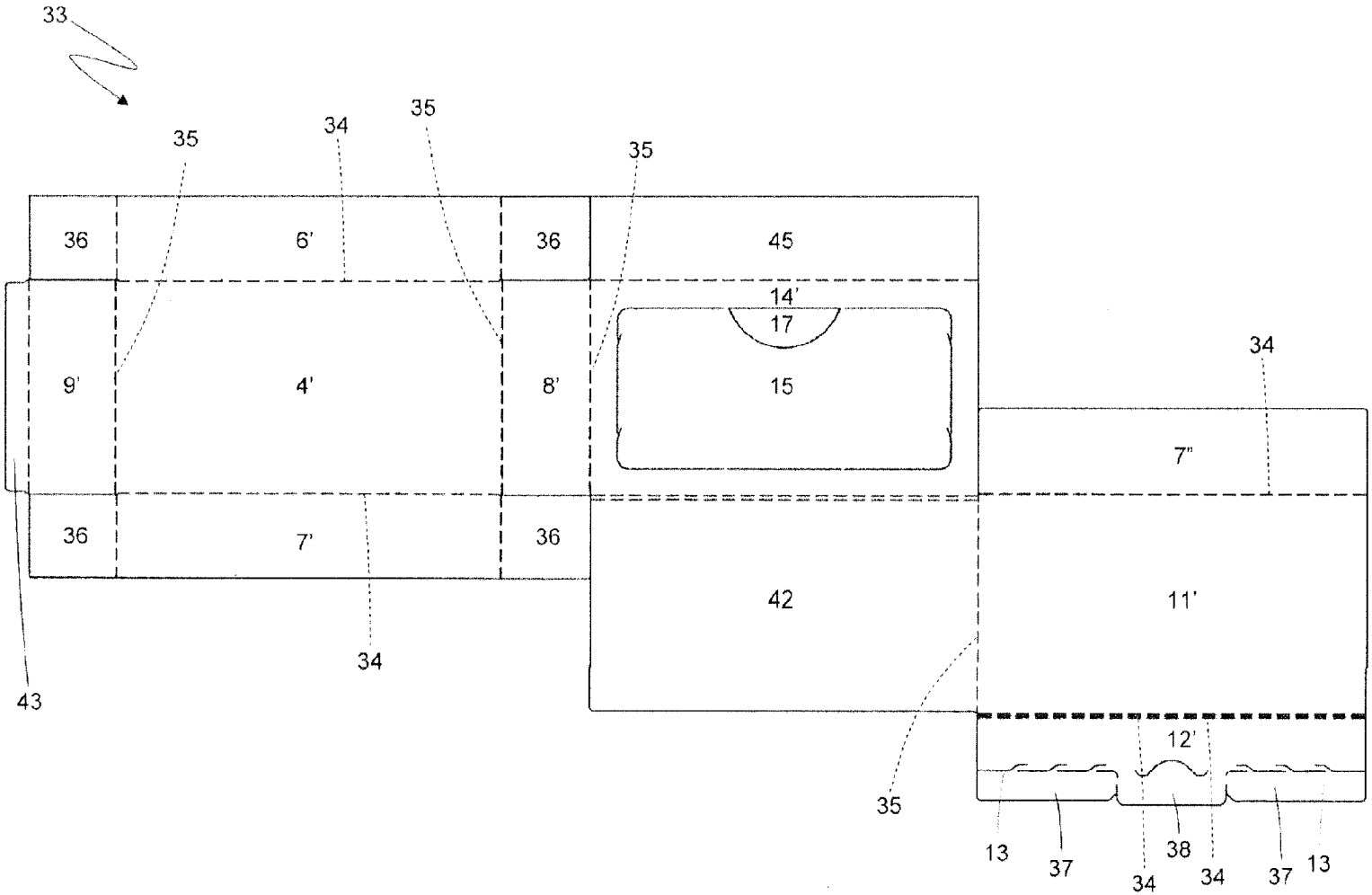
FIG. 17 shows a spread-out plan view of an alternative embodiment of the FIG. 14 blank.
Figure 18:
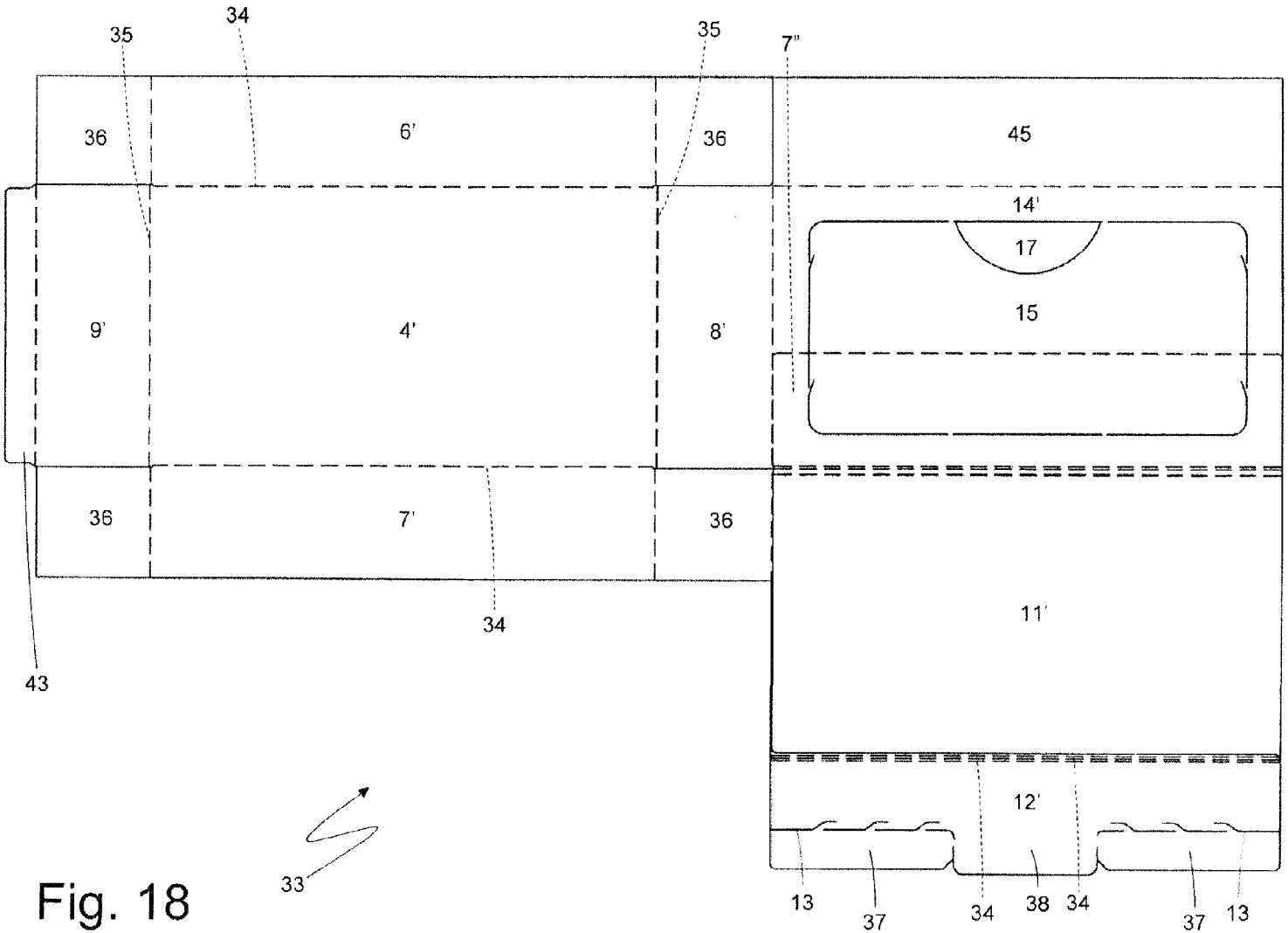
FIGS. 18 and 19 show plan views of the FIG. 17 blank partly folded.

From the fully spread-out configuration in FIG. 14, blank 33 is prefolded into the rectangle shown in FIG. 16 (which, in terms of size and folding, is equivalent to blank 33 in FIG. 9). Prefolding blank 33 comprises first folding panel 11' through 180° with respect to panel 42 and along transverse fold line 35 to superimpose panel 11' on panel 42 (as shown in FIG. 15); and then folding panel 42 (together with superimposed panel 11') through 180° with respect to panel 14' and along longitudinal fold line 34 to superimpose panel 14' on panel 11' (with panel 42 interposed between panels 14' and 11'). Permanent glue is applied between panel 42 and panels 14' and 11', so that panel 42 is glued on one side to panel 14', and on the other side to panel 11'. The above prefolding operation may be performed either on, or before feeding blank 33 to, the packing machine producing packet 1 of cigarettes (e.g. by the manufacturer of blank 33).

In a preferred embodiment, two parallel adjacent longitudinal fold lines 34 (obviously only a small distance apart) are provided between panels 11' and 12' to make blank 33 more flexible in this area, and so prevent panel 11' (i.e. top wall 11 of lid 10) from arching as a result of the stress produced in blank 33 once it is folded. In other words, the two longitudinal fold lines 34 between panels 11' and 12' serve to keep top wall 11 of lid 10 perfectly flat, and so improve the look of packet 1 of cigarettes when open.

In a preferred embodiment, blank 33 comprises an appendix 43 connected to panel 9' along a transverse fold line 35, and which is glued to a bottom surface of panel 14; and an appendix 44 connected to panel 6' along a longitudinal fold line 34, and which is also glued to a bottom surface of panel 14'.

In the FIG. 17-22 variation, blank 33 has no appendix 44, which is replaced with a panel 45 connected to panel 14' along a longitudinal fold line 34, interposed between panel 6' and panel 12', and glued on one side to panel 6', and on the other side to panel 12'.

Blank 33 in FIG. 14 has the advantage, firstly, of incorporating blank 39, so the packing machine producing packet 1 of cigarettes need only be supplied with blank 33, thus simplifying management of the packing material; and, secondly, of tear line 13 only extending along front wall 12 of lid 10, and connecting part of front wall 12 of lid 10 to front wall 6 of container 2 (or, rather, to detachable portions 37 glued to front wall 6 of container 2), so the top edges of lateral walls 8 and 9 of container 2 and the lateral edges of top wall 11 of lid 10 are left untorn, thus improving the look of packet 1 of cigarettes when open.

Figure 23:
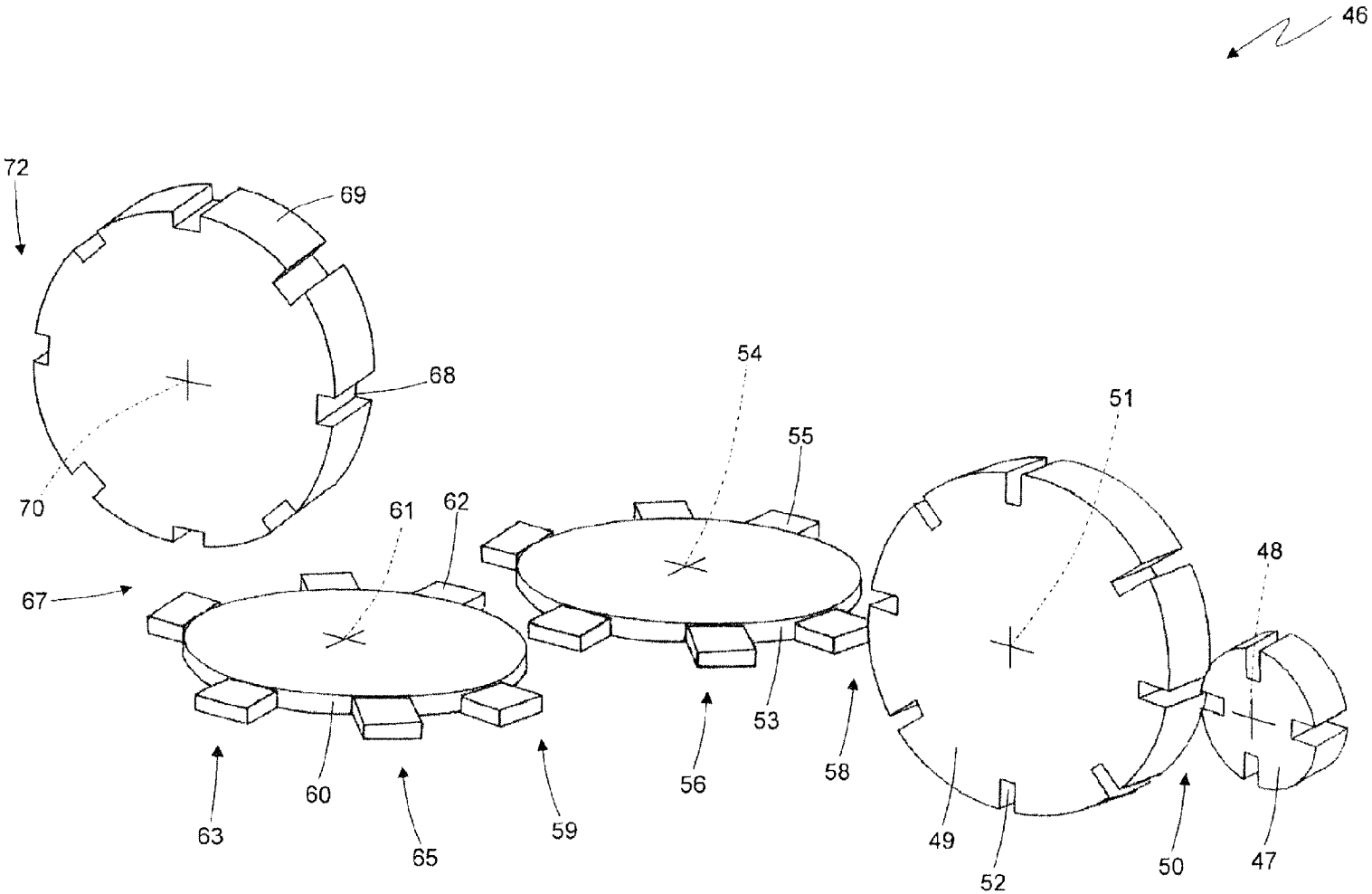
FIG. 23 shows a schematic view in perspective, with parts removed for clarity, of part of a packing machine for producing the FIG. 1 packet.
Figure 24:
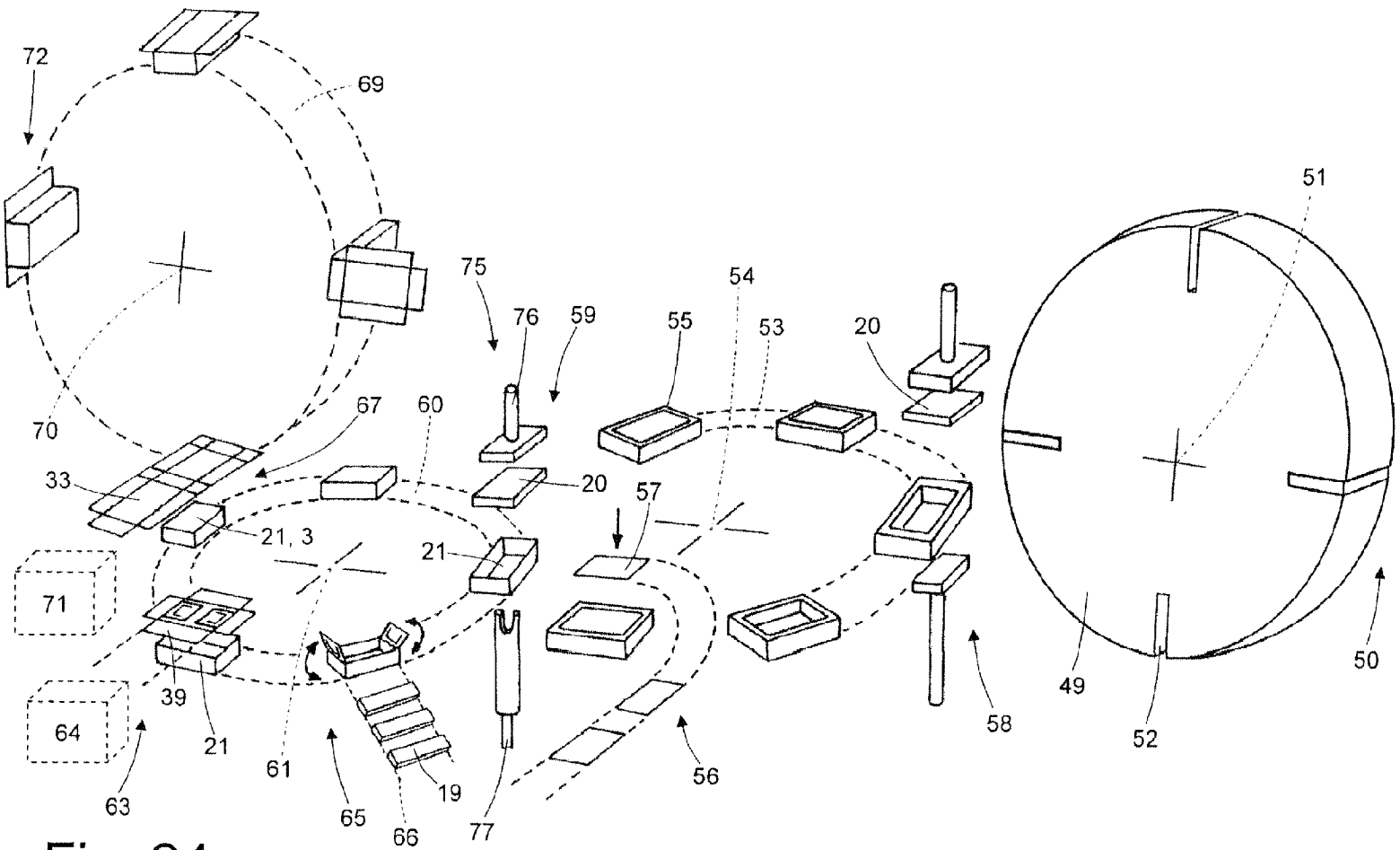
FIG. 24 shows a schematic view in perspective of operation of the FIG. 23 packing machine.

FIGS. 23 and 24 show part of a cigarette packing machine 46 for producing a packet 1 of cigarettes as described above and shown in FIGS. 1-8, using blank 33 in FIG. 9, or blank 39 in FIG. 10, and which operates in the same way as packing machine X3 manufactured by G.D. Società per Azioni.

Cigarette packing machine 46 comprises a group forming line (not shown) for forming groups of cigarettes; and a transfer wheel 47, which rotates in steps about a horizontal axis of rotation 48 to receive and transfer the groups of cigarettes successively to a packing wheel 49 at a transfer station 50. Packing wheel 49 rotates in steps about an axis of rotation 51 parallel to axis of rotation 48, and comprises a number of peripheral pockets 52, each for receiving a group of cigarettes together with a respective sheet of flexible foil packing material (not shown). And packing wheel 49 folds each sheet of packing material about the respective group of cigarettes to form a wrapped group of cigarettes defining article 20 of content 3 of packet 1 of cigarettes.

Packing machine 46 also comprises a transfer wheel 53, which rotates in steps about a vertical axis of rotation 54 crosswise to axis of rotation 48, and comprises a number of peripheral pockets 55, which are fed in steps about axis of rotation 54 to travel successively through a coupon feed station 56 where each pocket 55 receives a coupon 57 (shown in FIG. 24); an article transfer station 58 where an article 20 is inserted into each pocket 55 and onto the previously supplied coupon 57; and a transfer station 59 where each article 20 is expelled from a pocket 55 and transferred vertically to a follow-up packing wheel 60. It is important to note that coupon feed station 56 is optional, i.e. need only be provided if a coupon 57 is to be inserted inside packet 1 of cigarettes. Obviously, when coupon feed station 56 is provided, each article 20 is fed onto a coupon 57, which follows article 20 throughout the formation of packet 1 of cigarettes.

Packing wheel 60 rotates in steps about an axis of rotation 61 parallel to axis of rotation 54, is identical in design to transfer wheel 53, and comprises a number of peripheral pockets 62. In both pockets 55 on transfer wheel 53, and pockets 62 on packing wheel 60, each rectangular-parallelepiped-shaped article 20 is positioned flat, i.e. with a minor lateral surface facing outwards, and with its longitudinal axis (parallel to the cigarette axes) crosswise to axes of rotation 54 and 61, and tangent to the periphery of transfer wheel 53 and packing wheel 60. Packing wheel 60 and transfer wheel 53 overlap at transfer station 59, and articles 20 are transferred from transfer wheel 53 to packing wheel 60 vertically in a direction parallel to axes of rotation 54 and 61. More specifically, transfer wheel 53 overlaps packing wheel 60, and each article 20 is transferred downwards, out through a bottom opening in pocket 55 on transfer wheel 53, and in through a top opening in pocket 62 on packing wheel 60 (obviously, pocket 55 is aligned vertically with pocket 62).

At a feed station 63 upstream from transfer station 59, a feed device 64 inserts a blank 39 into a pocket 62 on packing wheel 60 to form an insert 21; and, at a feed station 65 between feed station 63 and transfer station 59 (i.e. upstream from transfer station 59), a feed device 66 inserts an object 19 into a pocket 62 on packing wheel 60 and onto the previously supplied insert 21. At transfer station 59, an article 20 is inserted into a pocket 62 on packing wheel 60 and onto the previously supplied insert 21 and object 20, thus completing formation of content 3 of packet 1 of cigarettes. It is important to note that, at feed station 63, blank 39 is inserted into a pocket 62 on packing wheel 60 already partly folded as shown in FIG. 11, i.e. with tabs 27 (together with tabs 28) folded 180° onto corresponding panels 24' and 25', after first applying permanent glue between tabs 27 and panels 24', 25'.

Figure 19:
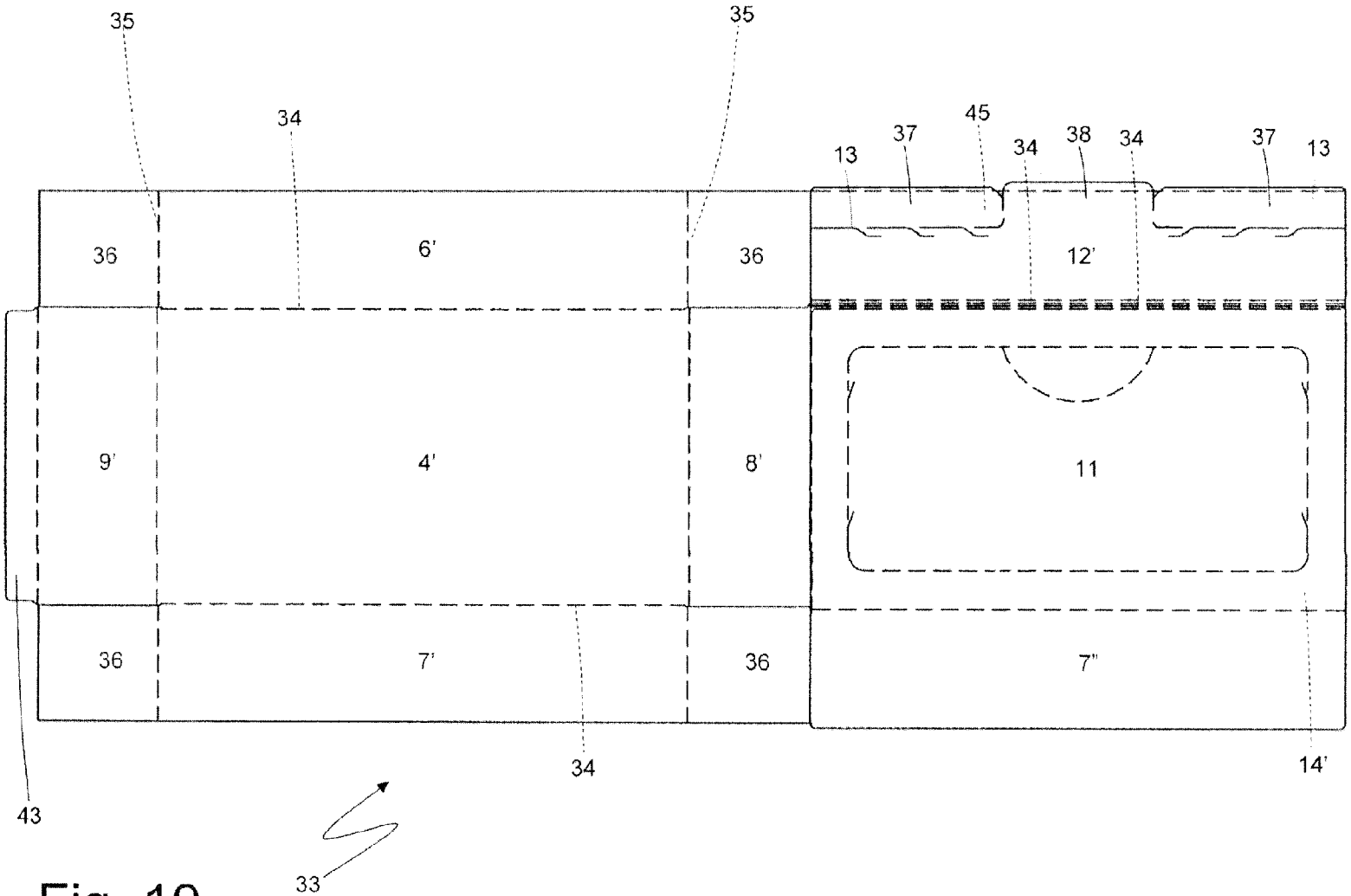
Figure 20:
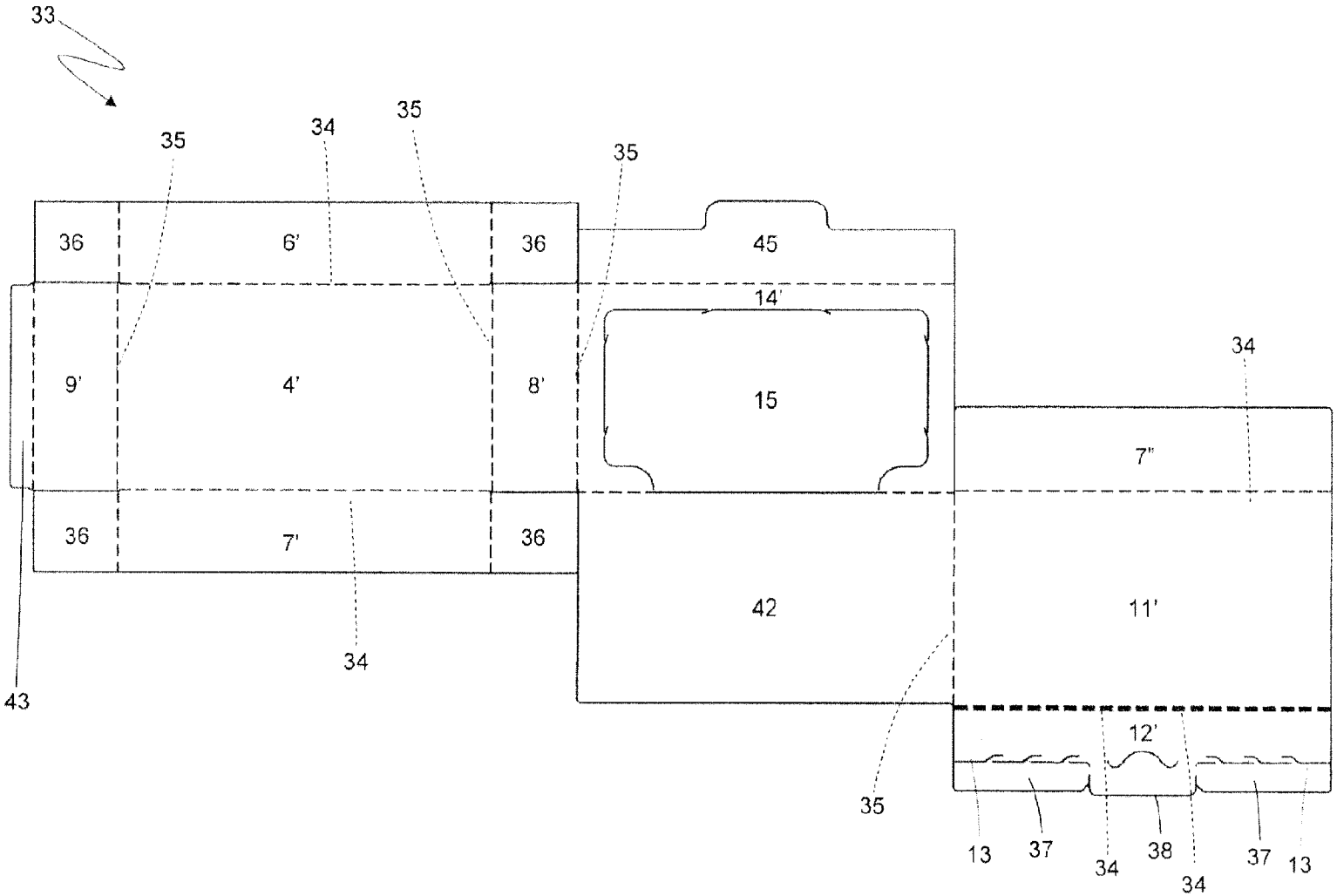
FIG. 20 shows a spread-out plan view of a further embodiment of the FIG. 14 blank.
Figure 21:
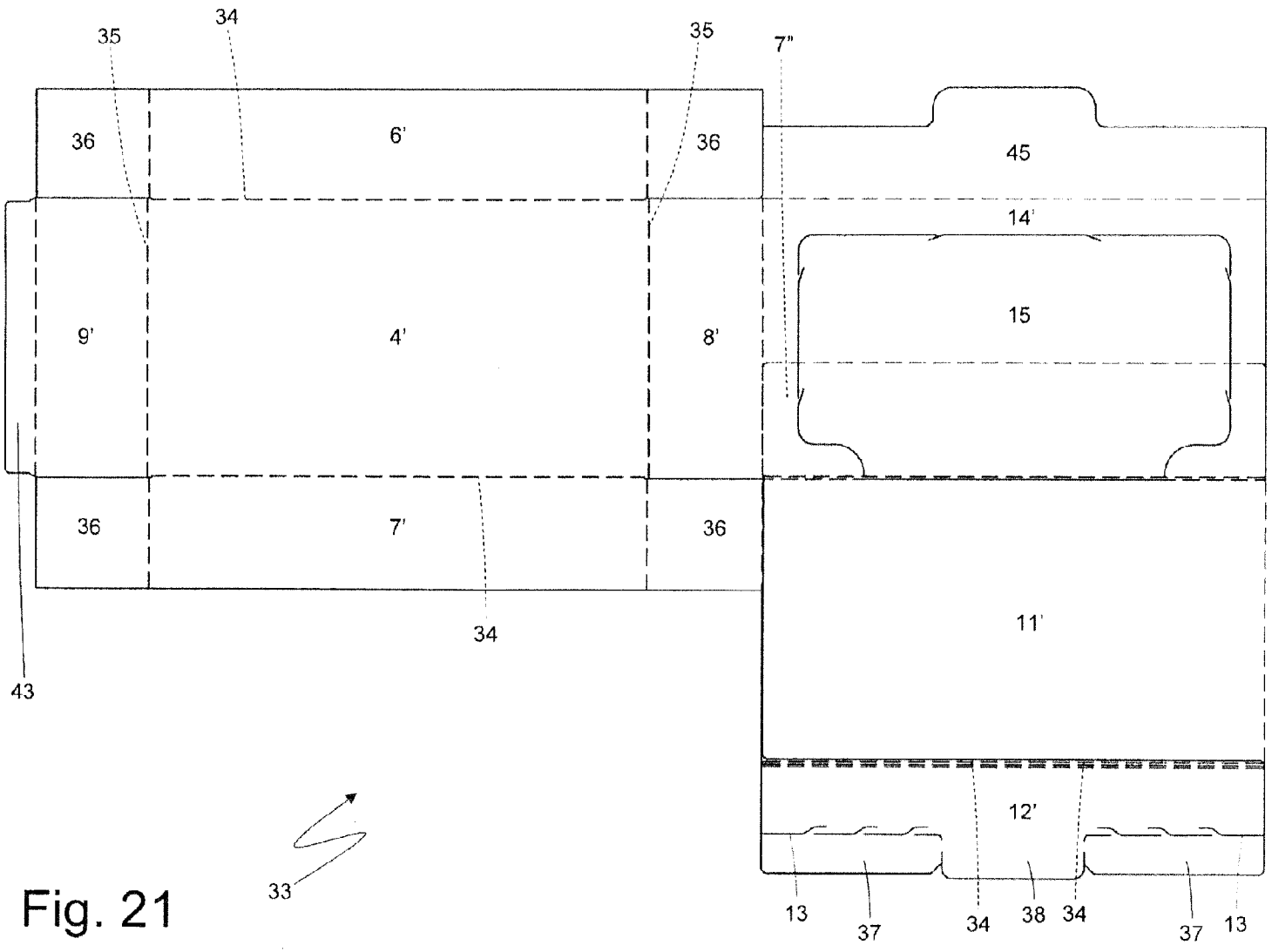
FIGS. 21 and 22 show plan views of the FIG. 20 blank partly folded.
Figure 22:
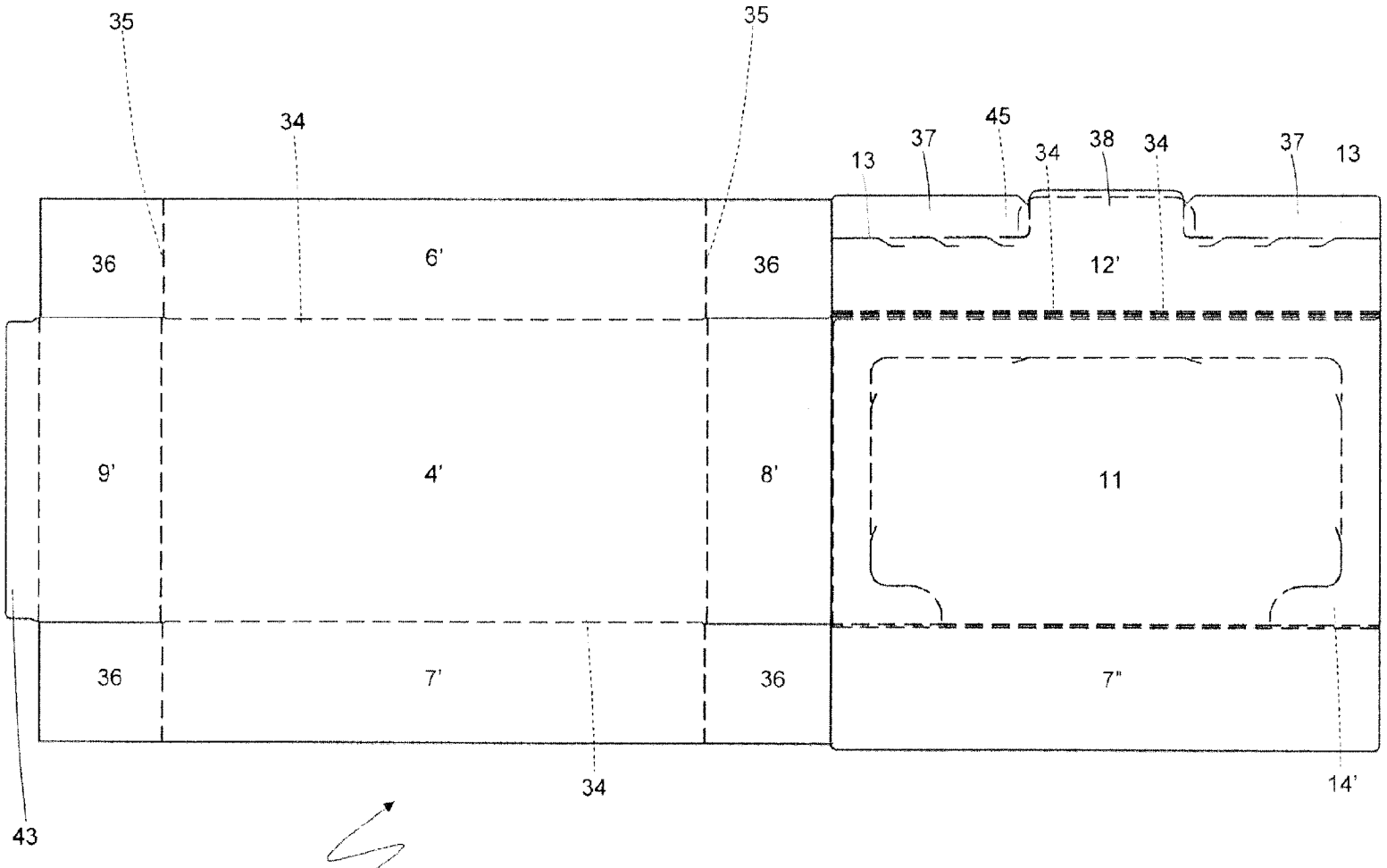

At a transfer station 67, each content 3, together with insert 21, is transferred from a pocket 62 on packing wheel 60 to a pocket 68 on a packing wheel 69, which rotates in steps about a horizontal axis of rotation 70 parallel to axis of rotation 48, receives each content 3 and respective insert 21 together with a respective rigid blank 33 fed to transfer station 67 by a feed device 71, and folds each blank about respective content 3 and insert 21 to form a packet 1 of cigarettes. It is important to note that, when using blank 33 in FIGS. 14-22, this is supplied at feed station 67 already partly folded as shown in FIGS. 16, 19 and 22.

At a transfer station 72, packets 1 of cigarettes are fed successively from packing wheel 69 to a further transfer wheel (not shown), from which they are fed to a drying area (not shown) forming the output of packing machine 46, and which feeds packets 1 of cigarettes to a follow-up cellophaning machine (not shown), which wraps each in a transparent plastic overwrap.

At feed station 63, feed device 64 feeds a blank 39, from which to form an insert 21, into a pocket 62 on packing wheel 60. As it is inserted into pocket 62, blank 39 folds inwards of pocket 62 to form a cup-shaped insert 21 with its inlet opening facing upwards (i.e. facing transfer wheel 53, from which article 20 is inserted into insert 21 at transfer station 59); and feed device 66 at feed station 65 then inserts an object 19 into pocket 62, and therefore into insert 21.

Figure 27:
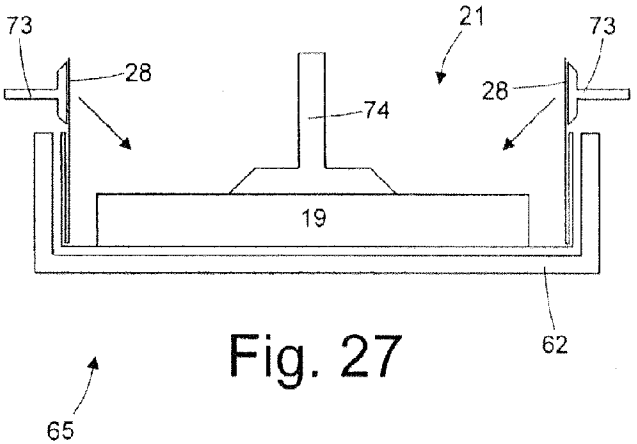
FIGS. 25-28 show, schematically, the operating sequence by which to feed an object into a pocket of a packing wheel of the FIG. 23 packing machine.
Figure 28:
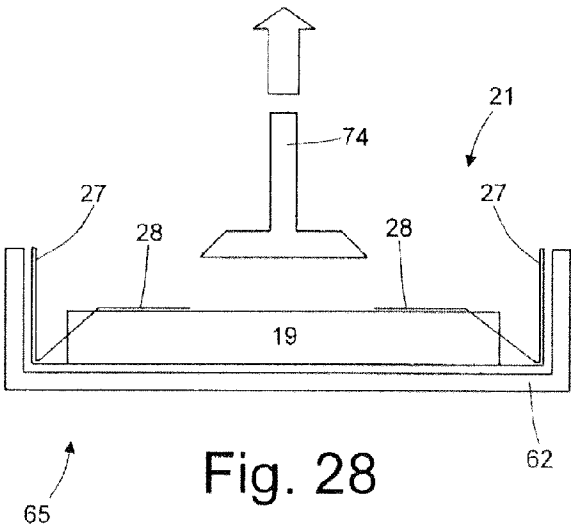
Figure 25:
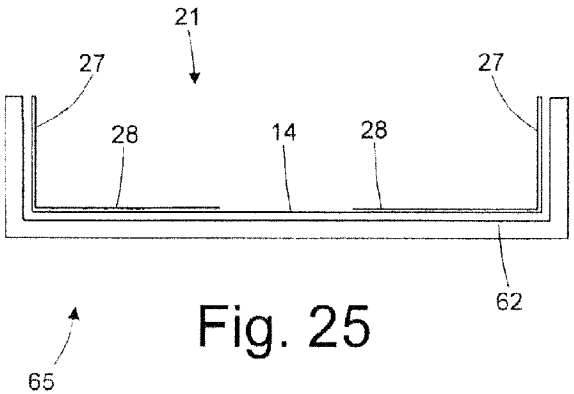
Figure 26:
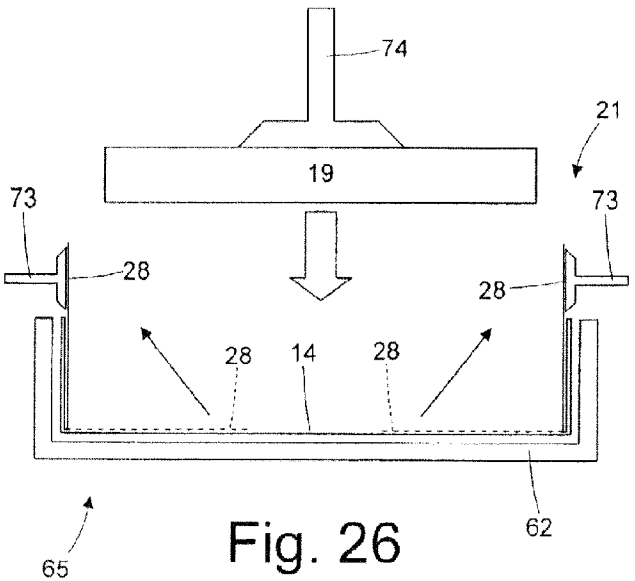

As shown in FIG. 25, when a pocket 62 reaches feed station 65, tabs 28 of insert 21 are positioned resting on border 14. As shown in FIG. 26, as soon as pocket 62 stops at feed station 65, two lateral suction gripping members 73 of feed device 66 engage and rotate tabs 28 of insert 21 through 90° from their initial position resting on and parallel to border 14, into a raised position perpendicular to border 14. As shown in FIG. 27, once tabs 28 of insert 21 are raised, object 19 is deposited onto border 14 of insert 21 by a central suction gripping member 74, which, after the object is deposited on border 14 of insert 21, remains contacting object 19 to hold it in position while gripping members 73 rotate tabs 28 of insert 21 down through 90° onto object 19, which is thus inserted inside the central recesses 29 in tabs 28, as shown in FIG. 28. Finally, gripping member 74 releases object 19 to allow pocket 62 to move from feed station 65 to transfer station 59.

Figure 30:
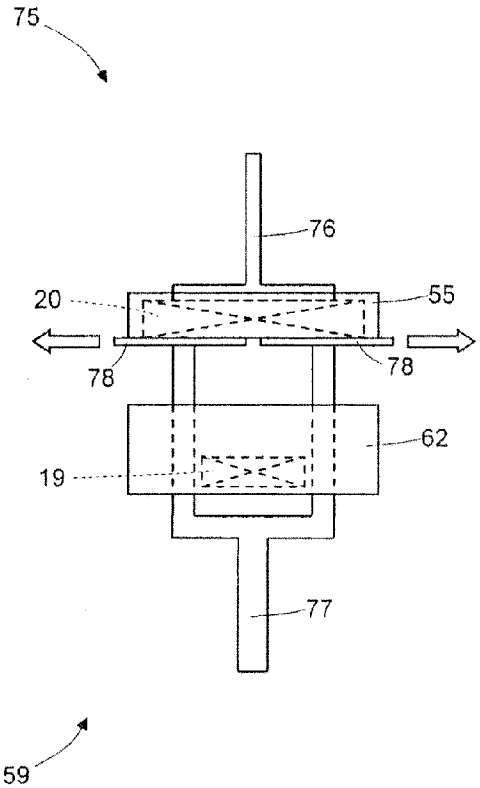
FIGS. 29-34 show, schematically, the operating sequence by which to feed a group of cigarettes into a pocket of a packing wheel of the FIG. 23 packing machine.
Figure 29:
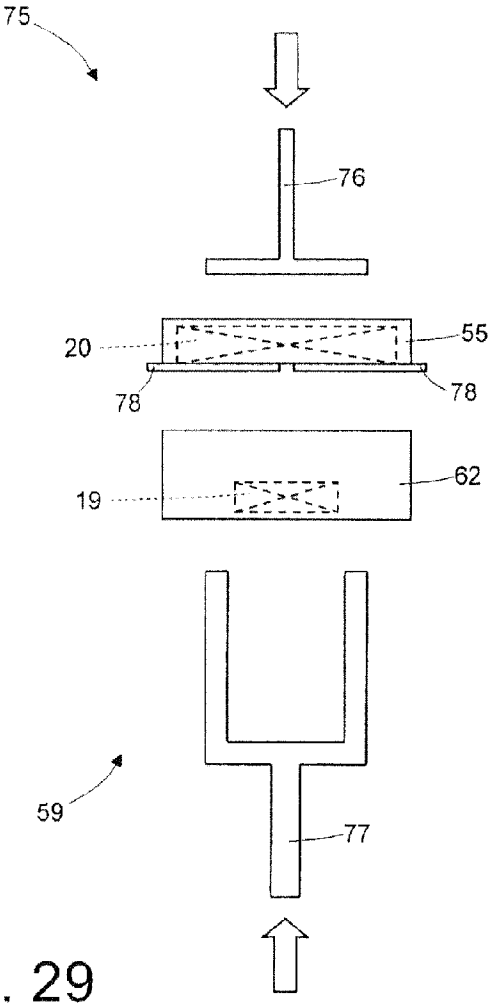
Figure 32:
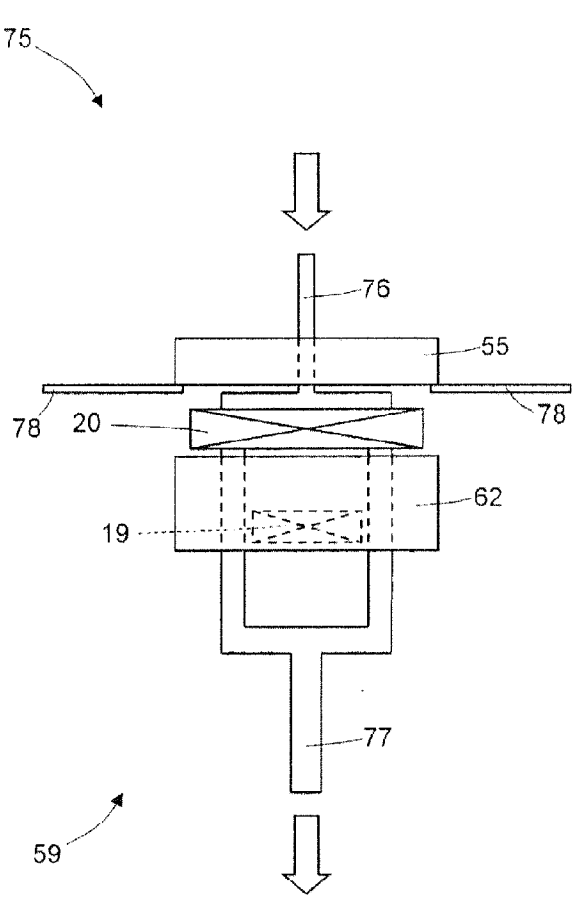
Figure 31:
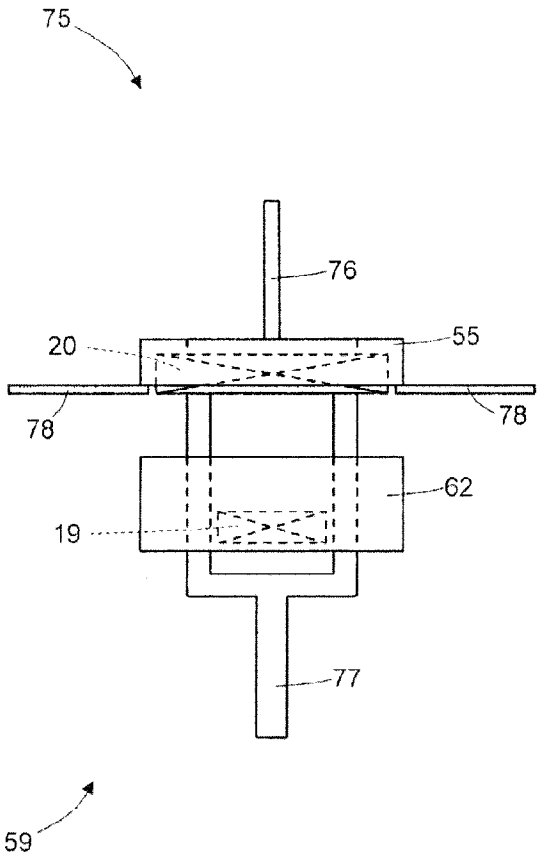
Figure 34:
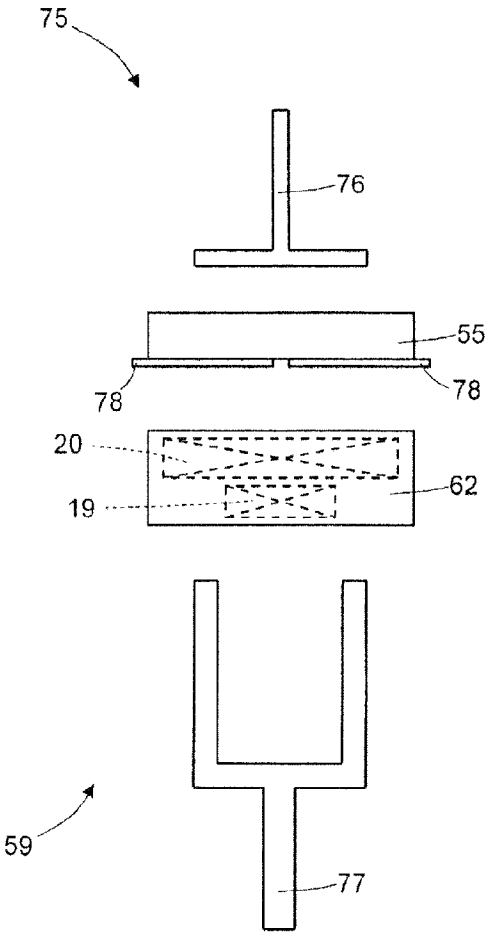
Figure 33:
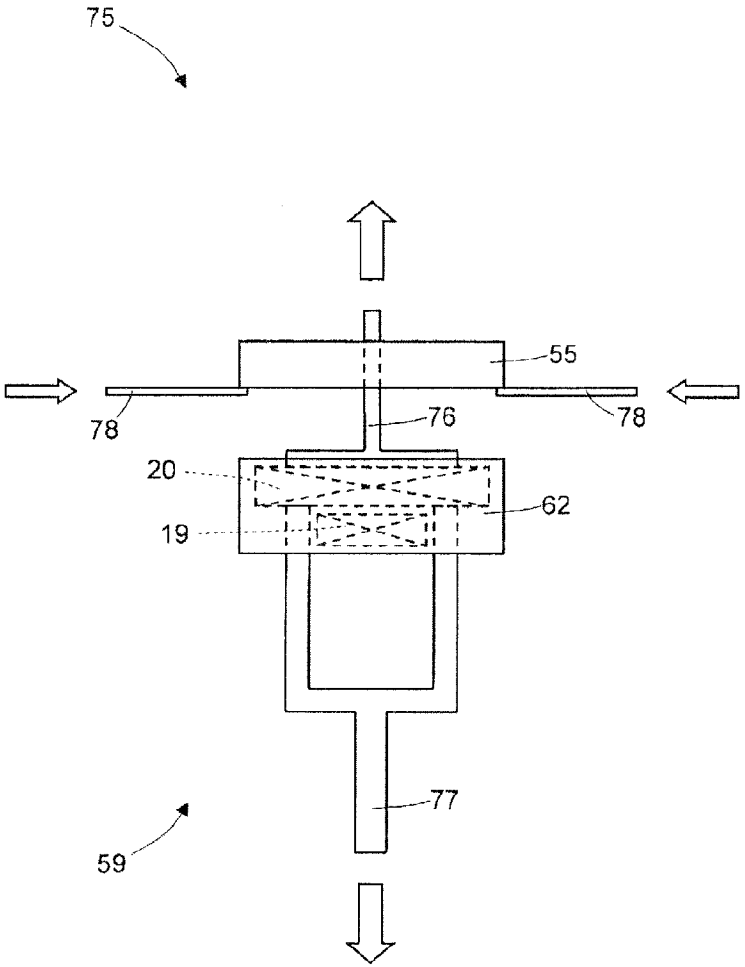

At transfer station 59, a pocket 55 on transfer wheel 53 is aligned vertically with a pocket 62 on packing wheel 60 underneath; and an article 20 is transferred from pocket 55 on transfer wheel 53 to pocket 62 on packing wheel 60 by a feed device 75 comprising a pusher 76 over transfer station 59, and a counterpusher 77 below transfer station 59. As shown in FIG. 29, at transfer station 59, the article 20 inside pocket 55 on transfer wheel 53 is supported underneath by two movable walls 78, i.e. rests on two movable walls 78 when pocket 55 reaches transfer station 59. As shown in FIG. 30, when pockets 55 and 62 reach transfer station 59, counterpusher 77 moves up into a position directly beneath movable walls 78, and pusher 76 moves down into pocket 55 and onto the top surface of article 20. At this point, as shown in FIG. 31, movable walls 78 are parted to allow article 20 to drop from the bottom of pocket 55 onto the waiting counterpusher 77 directly beneath movable walls 78. As shown in FIG. 31, when article 20 comes to rest on counterpusher 77 underneath, pusher 76 moves down slightly to grip article 20 together with counterpusher 77. As shown in FIG. 32, once article 20 is gripped between pusher 76 and counterpusher 77, pusher 76 and counterpusher 77 move down together to insert article 20 into pocket 62 underneath, and therefore into insert 21. As shown in FIG. 33, once article 20 is inserted correctly inside pocket 62, pusher 76 moves back up, and counterpusher 77 back down into their original positions. And finally, once pusher 76 returns to its original position, movable walls 78 are brought back together into their original position to repeat the transfer cycle for the next pocket 55, as shown in FIG. 34.

Counterpusher 77 is fork-shaped, i.e. U-shaped (with two parallel, spaced arms), to avoid interfering with object 19, which is located between the two arms of the fork, as counterpusher 77 moves up through pocket 62 on packing wheel 60 to engage article 20. It is important to note that, to move through pocket 62 on packing wheel 60, counterpusher 77 must also move through border 14 of insert 21 located inside pocket 62. This is made possible by through hole 17 in border 14, through which counterpusher 77 moves, and which is essential to enable counterpusher 77 to move up through pocket 62 on packing wheel 60, to engage article 20. Obviously, pocket 62 on packing wheel 60 must also have a through hole aligned with through hole 17 in border 14, and through which to move counterpusher 77.

At transfer station 67, content 3 (i.e. object 19 and article 20) enclosed in insert 21 is transferred from a pocket 62 on packing wheel 60 to a pocket 68 on packing wheel 69, together with a blank 33. At this stage, blank 33 is inserted into pocket 68 folded into a U about content 3 in insert 21, and, inside pocket 68 on packing wheel 69, is folded about content 3 in insert 21 to form container 2 with lid 10, and so complete packet 1 of cigarettes.

When content 3 of packet 1 of cigarettes only comprises one or more articles 20 (i.e. one or more wrapped groups of cigarettes), only minor alterations to packing machine 46 are required: feed device 66 supplying objects 19 must obviously be disabled; the type of blank 39 supplied at feed station 63 must be changed (i.e. the FIG. 12 or FIG. 13 blank 39 substituted for blank 39 in FIG. 10); and article 20 must be changed in size or increased in number (normally, only one article 20 is inserted with an object 19, which is the same thickness as article 20; and two superimposed articles 20 are inserted when no object 19 is included).

Obviously, content 3 of packet 1 of cigarettes may differ from that described by way of example: as opposed to a lighter, object 19 may be any rigid object (such as a cigarette-holder); and, instead of a wrapped group of cigarettes, article 20 may be any other type of article (such as a group of cigarette-holder filters).

Packet 1 of cigarettes described has numerous advantages, by being able to house a rigid object 19, while at the same time being produced on a substantially standard packing machine 46 (i.e. identical to a standard packing machine, except for a few minor alterations to adapt to the new format). In particular, rigid object 19 is accommodated firmly inside packet 1 of cigarettes, and can be repeatedly removed and replaced easily.

Given its numerous advantages, the design of packet 1 of cigarettes described may also be used for producing cartons of cigarettes, which are substantially identical to packet 1 of cigarettes described, the only difference being that content 3 is defined by a group of packets of cigarettes.

Packing machine 46 described also has numerous advantages, by being identical to a standard packing machine, and by effectively producing packet 1 of cigarettes described.

The invention claimed is:

1. A package comprising:

a parallelepiped-shaped container (2), which is cup-shaped and comprises a bottom wall (4); an open top end (5) opposite the bottom wall (4); a front wall (6) and a rear wall (7) opposite and parallel to each other; and two parallel lateral walls (8, 9) interposed between the front wall (6) and rear wall (7);

a lid (10), which rotates between a closed position and an open position respectively closing and opening the open top end (5) of the container (2), and comprises a top wall (11) hinged to the rear wall (7) of the container (2); and a front wall (12) which, in the closed position, is superimposed on the front wall (6) of the container (2);

a border (14) which is parallel to the bottom wall (4), surrounds the open top end (5) along at least three sides to reduce the size of the open top end (5), and on which the top wall (11) of the lid (10) in the closed position rests; and an insert (21), which comprises the border (14), is initially separate from the container (2), and is glued inside the container (2);

wherein the container (2) and the lid (10) are formed by folding a single blank (33) having two longitudinal fold lines (34), and a number of transverse fold lines (35);

wherein in the blank (33) the transverse fold lines (35) define, between the two longitudinal fold lines (34), a first panel (9') forming part of a first lateral wall (9) of the container (2); a second panel (4') forming the bottom wall (4) of the container (2); a third panel (8') forming a second lateral wall (8) of the container (2); a fourth panel (11') forming the top wall (11) of the lid (10); and a fifth panel (9") forming a further part of the first lateral wall (9) of the container (2);

wherein the first panel (9') and fifth panel (9") are superimposed and glued to each other to form the first lateral wall (9) of the container (2); and wherein the fourth panel (11') is connected to the third panel (8') and to the fifth panel (9") along a tear line (13).

2. A package as claimed in claim 1, wherein the blank (33) comprises a sixth panel (7') connected to the second panel (4') along a first longitudinal fold line (34), and which forms an inner portion of the rear wall (7) of the container; and a seventh panel (6') connected to the second panel (4') along a second longitudinal fold line (34), and which forms the front wall (6) of the container (2).

3. A package as claimed in claim 2, wherein the sixth panel (7') and seventh panel (6') comprise respective pairs of tabs (36), which are connected respectively to the sixth panel (7') and seventh panel (6') along transverse fold lines (35), are folded 90° with respect to the respective sixth panel (7') and seventh panel (6'), and are glued respectively to an inner surface of the first panel (9') and an inner surface of the third panel (8').

4. A package as claimed in claim 1, wherein the blank (33) comprises an eighth panel (7") connected to the fourth panel (11') along a first longitudinal fold line (34), and which forms an outer portion of the rear wall (7) of the container (2); and a ninth panel (12') connected to the fourth panel (11') along a second longitudinal fold line (34), and which forms the front wall (12) of the lid (10).

5. A package as claimed in claim 4, wherein the ninth panel (12') comprises at least one detachable portion (37), which is glued to a seventh panel (6') forming the front wall (6) of the container (2), and is connected along a first tear line (13) to the rest of the ninth panel (12') forming the front wall (12) of the lid (10).

6. A package as claimed in claim 1, wherein the border (14) comprises a cover (15), which initially closes the open top end (5) within the border (14), is initially connected to the edges of the border (14) along a second tear line (16), and is glued to an inner surface of the top wall (11) of the lid (10), so as to be torn off the border (14) along the second tear line (16) when the lid (10) is unsealed.

7. A package as claimed in claim 6, wherein the cover (15) comprises a central through hole (17).

8. A package as claimed in claim 7, wherein the inner surface of the top wall (11) of the lid (10) has printing (18) at the through hole (17) of the cover (15).

9. A package as claimed in claim 1, wherein the insert (21) comprises a front wall (22) which is glued to an inner surface of the front wall (6) of the container (2); a rear wall (23) which is glued to an inner surface of the rear wall (7) of the container (2); and two lateral walls (24, 25) which are glued to the inner surfaces of the lateral walls (8, 9) of the container (2).

10. A package as claimed in claim 1, wherein the insert (21) comprises two lateral walls (24, 25) which are glued to the inner surfaces of the lateral walls (8, 9) of the container (2); and two supports (26) connected to the lateral walls (24, 25) of the insert, and projecting inwards of the container (2) to support the content (3) of the container (2).

11. A package as claimed in claim 10, wherein each support (26) comprises a first tab (27) connected to a bottom edge of the lateral wall (24, 25) of the insert (21), and which is folded and glued onto the lateral wall (24, 25) of the insert (21); and a second tab (28) connected to the first tab (27), and projecting inwards of the container (2) to support the content (3) of the container (2).

12. A package as claimed in claim 11, wherein each second tab (28) comprises a central through recess (29) which is engaged by a rigid object (19) forming part of the content (3) of the container (2), and is defined by a U-shaped through cut (30).

13. A package as claimed in claim 12, wherein each second tab (28) has a fold line (31) which forms an intermediate fold in the second tab (28), and is located at the tips of the U-shaped through recess (30).

14. A package comprising:

a parallelepiped-shaped container (2), which is cup-shaped and comprises a bottom wall (4); an open top end (5) opposite the bottom wall (4); a front wall (6) and a rear wall (7) opposite and parallel to each other; and two parallel lateral walls (8, 9) interposed between the front wall (6) and rear wall (7);

a lid (10), which rotates between a closed position and an open position respectively closing and opening the open top end (5) of the container (2), and comprises a top wall (11) hinged to the rear wall (7) of the container (2); and a front wall (12) which, in the closed position, is superimposed on the front wall (6) of the container (2); and a border (14) which is parallel to the bottom wall (4), surrounds the open top end (5) along at least three sides to reduce the size of the open top end (5), and on which the top wall (11) of the lid (10) in the closed position rests;

wherein the container (2) and the lid (10) are formed by folding a single blank (33) having two longitudinal fold lines (34), and a number of transverse fold lines (35);

wherein in the blank (33) the transverse fold lines (35) define, between the two longitudinal fold lines (34), a first panel (9') forming part of a first lateral wall (9) of the container (2); a second panel (4') forming the bottom wall (4) of the container (2); a third panel (8') forming a second lateral wall (8) of the container (2); a fourth panel (11') forming the top wall (11) of the lid (10); and a fifth panel (9") forming a further part of the first lateral wall (9) of the container (2);

wherein the first panel (9') and fifth panel (9") are superimposed and glued to each other to form the first lateral wall (9) of the container (2);

wherein the fourth panel (11') is connected to the third panel (8') and to the fifth panel (9") along a tear line (13); and wherein the border (14) comprises a cover (15), which initially closes the open top end (5) within the border (14), is initially connected to the edges of the border (14) along a second tear line (16), and is glued to an inner surface of the top wall (11) of the lid (10), so as to be torn off the border (14) along the second tear line (16) when the lid (10) is unsealed.

15. A package as claimed in claim 14, wherein the cover (15) comprises a central through hole (17).

16. A package as claimed in claim 15, wherein the inner surface of the top wall (11) of the lid (10) has printing (18) at the through hole (17) of the cover (15).

* * * * *